US011801988B2

(12) United States Patent
Wehrmann

(10) Patent No.: US 11,801,988 B2
(45) Date of Patent: Oct. 31, 2023

(54) ON-DEMAND INFLATABLE PACKAGING

(71) Applicant: AUTOMATED PACKAGING SYSTEMS, LLC, Streetsboro, OH (US)

(72) Inventor: Rick Wehrmann, Hudson, OH (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

(21) Appl. No.: 17/615,872

(22) PCT Filed: Jun. 1, 2020

(86) PCT No.: PCT/US2020/035501
§ 371 (c)(1),
(2) Date: Dec. 2, 2021

(87) PCT Pub. No.: WO2020/247296
PCT Pub. Date: Dec. 10, 2020

(65) Prior Publication Data

US 2022/0340351 A1 Oct. 27, 2022

Related U.S. Application Data

(60) Provisional application No. 62/856,520, filed on Jun. 3, 2019.

(51) Int. Cl.
*B65D 81/05* (2006.01)
*B65D 81/03* (2006.01)
*B65D 65/38* (2006.01)

(52) U.S. Cl.
CPC ..... *B65D 81/03* (2013.01); *B65D 65/38* (2013.01)

(58) Field of Classification Search
CPC ..... B65D 75/42; B65D 75/44; B65D 81/03; B65D 81/2038; B65D 81/2023; B65D 77/225; B65D 31/145; B65D 81/022; B65D 81/052
USPC ..... 206/521, 522; 383/3
See application file for complete search history.

(56) References Cited

U.S. PATENT DOCUMENTS 4,551,379 A * 11/1985 Kerr ..... B32B 27/32 206/522
5,944,424 A 8/1999 Lerner et al.
5,987,856 A 11/1999 Lerner
6,055,796 A 5/2000 Lerner et al.
6,170,238 B1 1/2001 Lerner
6,423,166 B1 7/2002 Simhaee
(Continued)

FOREIGN PATENT DOCUMENTS

WO 2018236697 A1 12/2018

*Primary Examiner* — King M Chu
(74) *Attorney, Agent, or Firm* — Jon Isaacson

(57) ABSTRACT

An inflatable packaging web (3201) includes a continuous web of preformed pouches (3200) and an outer skin (612). The continuous web of preformed pouches is defined by two panels (18) connected together along first and second side edges (14) and either connected together or folded along a bottom edge (20). At least one of the panels is inflatable. The outer skin is disposed over at least one of the inflatable panels. The outer skin is attached to the at least one of the inflatable panels along at least a portion of the height of the first and second side edges. The preformed pouch includes at least one fold such that a folded portion (3215) of the two panels is folded over a first portion of the two panels.

15 Claims, 29 Drawing Sheets

(56) References Cited

U.S. PATENT DOCUMENTS

| | | | | |
|---|---|---|---|---|
| 6,543,201 | B2 | 4/2003 | Cronauer et al. | |
| 6,742,317 | B2 | 6/2004 | Cronauer et al. | |
| 6,948,296 | B1 | 9/2005 | Lerner et al. | |
| 7,513,090 | B2 | 4/2009 | Wehrmann | |
| 7,552,571 | B2 | 6/2009 | Lerner et al. | |
| D596,031 | S | 7/2009 | Wehrmann | |
| D646,972 | S | 10/2011 | Wehrmann | |
| 8,038,348 | B2 | 10/2011 | Lerner et al. | |
| 8,307,617 | B2 | 11/2012 | Riccardi et al. | |
| 8,357,439 | B2 | 1/2013 | Wehrmann | |
| 8,568,029 | B2 * | 10/2013 | Kannankeril | B65B 55/20 383/3 |
| 8,672,133 | B2 * | 3/2014 | Liao | B65D 81/052 206/592 |
| 8,910,664 | B2 * | 12/2014 | Liao | B65D 81/052 446/224 |
| 2009/0029342 | A1 | 1/2009 | Su et al. | |
| 2012/0214658 | A1 | 8/2012 | Chuba | |
| 2014/0260094 | A1 * | 9/2014 | Wehrmann | B31B 70/946 53/410 |
| 2015/0209992 | A1 | 7/2015 | Lerner | |

* cited by examiner

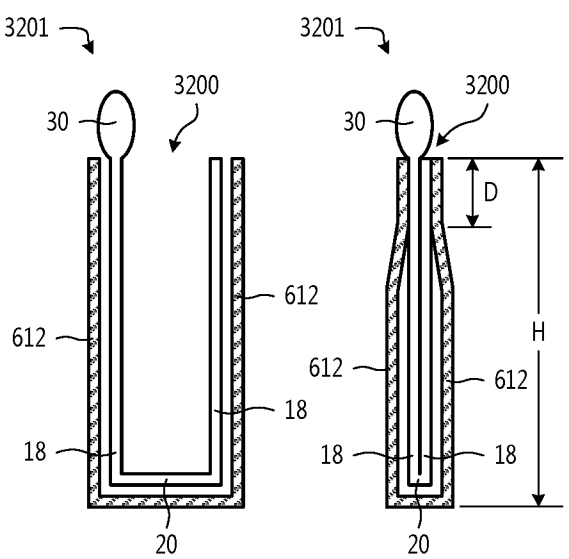
Fig. 32C
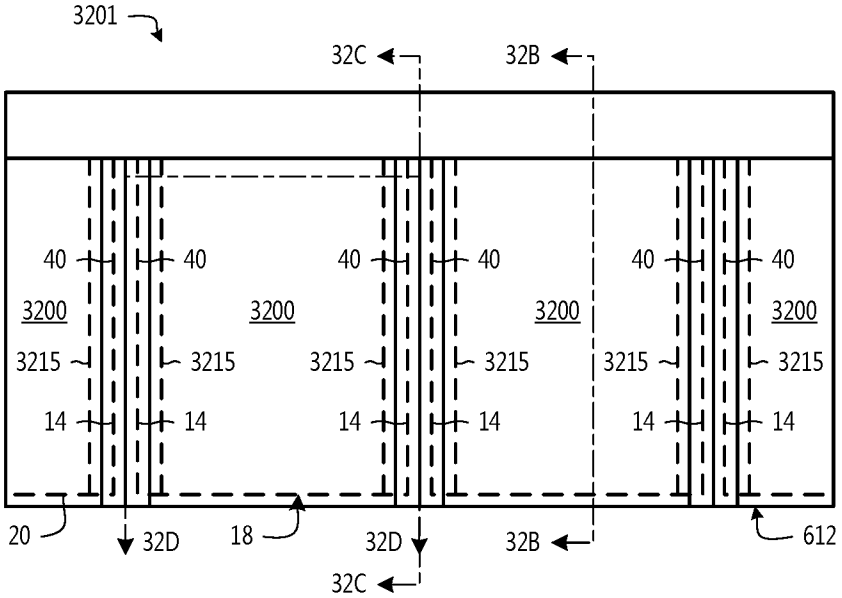
Fig. 32B
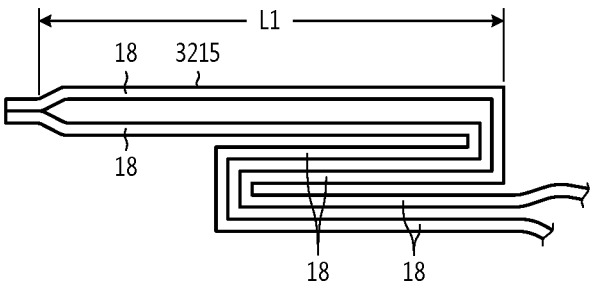
Fig. 32E
Fig. 32A
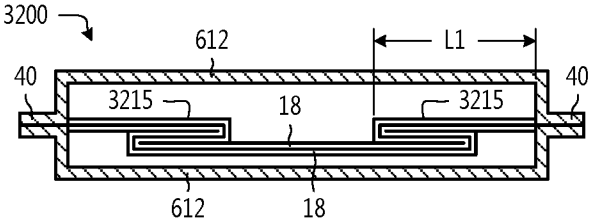
Fig. 32D

ON-DEMAND INFLATABLE PACKAGING

BACKGROUND

Air cellular sheet material, such as BUBBLE WRAP® air cellular material produced by Sealed Air corporation of Charlotte, N.C., is widely-used as a packaging material. One known use of air cellular sheet material is a cushioning material, for example, which can be wrapped around a product or within a larger package, such as within a box, corrugate, a bag, or paper. For example, cushioning material is used within the inside of a paper skin as a padded envelope.

A typical padded envelope includes cushioning material formed by a vacuum process that includes laminating or sealing two layers of plastic together. After the two layers of plastic are laminated or sealed together, a small amount of air is trapped within each cell to create a cushioning characteristic.

Conventionally, a padded envelope is manufactured at an assembly site. At the assembly site, the cushioning material is formed and attached to the paper skin. The envelope may be shipped to a point of retail sale, or a product may be packed within the padded envelope at a packaging site. In either example, the padded envelopes are shipped in a final size and volume with the inflation pattern fully inflated.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In a first embodiment, an inflatable packaging web includes a continuous web of preformed pouches and an outer skin. The continuous web of preformed pouches is defined by two panels connected together along first and second side edges and either connected together or folded along a bottom edge. At least one of the panels is inflatable. The outer skin is disposed over at least one of the inflatable panels. The outer skin is attached to the at least one of the inflatable panels along at least a portion of the height of the first and second side edges. The preformed pouch includes at least one fold such that a folded portion of the two panels is folded over a first portion of the two panels.

In a second embodiment, the fold of the first embodiment is between the first and second side edges of the two panels.

In a third embodiment, the outer skin of the second embodiment is attached to the at least one of the inflatable panels along the entire height of the first and second side edges.

In a fourth embodiment, the at least one fold of any of the second to third embodiments is arranged to unfold upon inflation of the preformed pouch.

In a fifth embodiment, a length of the outer skin of the fourth embodiment is between 75% and 125% of a length of the inflated and unfolded preformed pouch.

In a sixth embodiment, a length of the outer skin of any of the fourth to fifth embodiments is about the same as a length of the inflated and unfolded preformed pouch.

In a seventh embodiment, the preformed pouch of any of the second to sixth embodiments includes a continuous inflation channel in fluid communication with the at least one of the inflatable panels and the continuous inflation channel extends along a top of the continuous web of preformed pouches.

In and eighth embodiment the at least one fold of any of the preceding embodiments is between a top edge and the bottom edge of the two panels.

In a ninth embodiment, the outer skin of the eighth embodiment is attached to the at least one of the inflatable panels along a portion of the first and second side edges that is less than the entire height of the first and second side edges.

In a tenth embodiment, the panels if any of the eighth to ninth embodiments have an unfolded height in an uninflated state, and the unfolded height is greater than or equal to a height of the outer skin.

In an eleventh embodiment, the panels of the tenth embodiment have a second unfolded height in the inflated state, and wherein the second unfolded height is less than the unfolded height from the uninflated state.

In a twelfth embodiment, the second unfolded height of the panels of the eleventh embodiment is less than or equal to the height of the outer skin.

In a thirteenth embodiment, the preformed pouch of any of the eighth to twelfth embodiments includes a continuous inflation channel in fluid communication with the at least one of the inflatable panels and the continuous inflation channel extends along a top of the continuous web of preformed pouches.

In a fourteenth embodiment, an inflatable packaging web includes a continuous web of preformed pouches, an outer skin, and a continuous inflation channel. The continuous web of preformed pouches is defined by two panels connected together along first and second side edges and connected together along a bottom edge or folded along a bottom edge. At least one of the panels includes an inflation pattern of interconnected rows that are inflatable. A length of each of the interconnected rows is greater than a height of each of the interconnected rows. The outer skin is disposed over at least one of the inflatable panels and the outer skin is attached to the inflatable panels at the first and second side edges. The continuous inflation channel in fluid communication with the inflation pattern and the continuous inflation channel extends along a top of the continuous web of preformed pouches.

In a fifteenth embodiment, an inflatable packaging web includes a continuous web of preformed pouches, an outer skin, and a continuous inflation channel. The continuous web of preformed pouches is defined by two panels connected together along first and second side edges and connected together along a bottom edge or folded along a bottom edge. At least one of the panels includes one or more inflation patterns of interconnected cells that are inflatable and a plurality of cuts that are movable between an open position and a closed position. The outer skin is disposed over at least one of the inflatable panels and the outer skin is attached to the inflatable panels at the first and second side edges. The continuous inflation channel is in fluid communication with the one or more inflation patterns. The continuous inflation channel extends along a top of the continuous web of preformed pouches. Inflation of one or more inflation patterns through the continuous inflation patterns causes the plurality of cuts to move from the closed position to the open position to reduce shrinkage of the at least one inflatable panel along a length of the inflatable panel.

BRIEF DESCRIPTION OF THE DRAWING

The foregoing aspects and many of the attendant advantages of the disclosed subject matter will become more readily appreciated as the same become better understood by reference to the following detailed description, when taken in conjunction with the accompanying drawings, wherein:

FIG. 32A is a front view of another exemplary embodiment of an inflatable packaging web;

FIG. 32B is a sectional view of the inflatable packaging web of FIG. 31A, shown along the line 32B-32B of FIG. 32A;

FIG. 32C is a sectional view of the inflatable packaging web of FIG. 32A, shown along the line 32C-32C of FIG. 32A;

FIG. 32D is a sectional view of an inflatable pouch of the inflatable packaging web of FIG. 32A, shown along the line 32D-32D of FIG. 32A;

FIG. 32E is an enlarged portion of the panels of the inflatable pouch of FIG. 32D;

DETAILED DESCRIPTION

Figure 1:
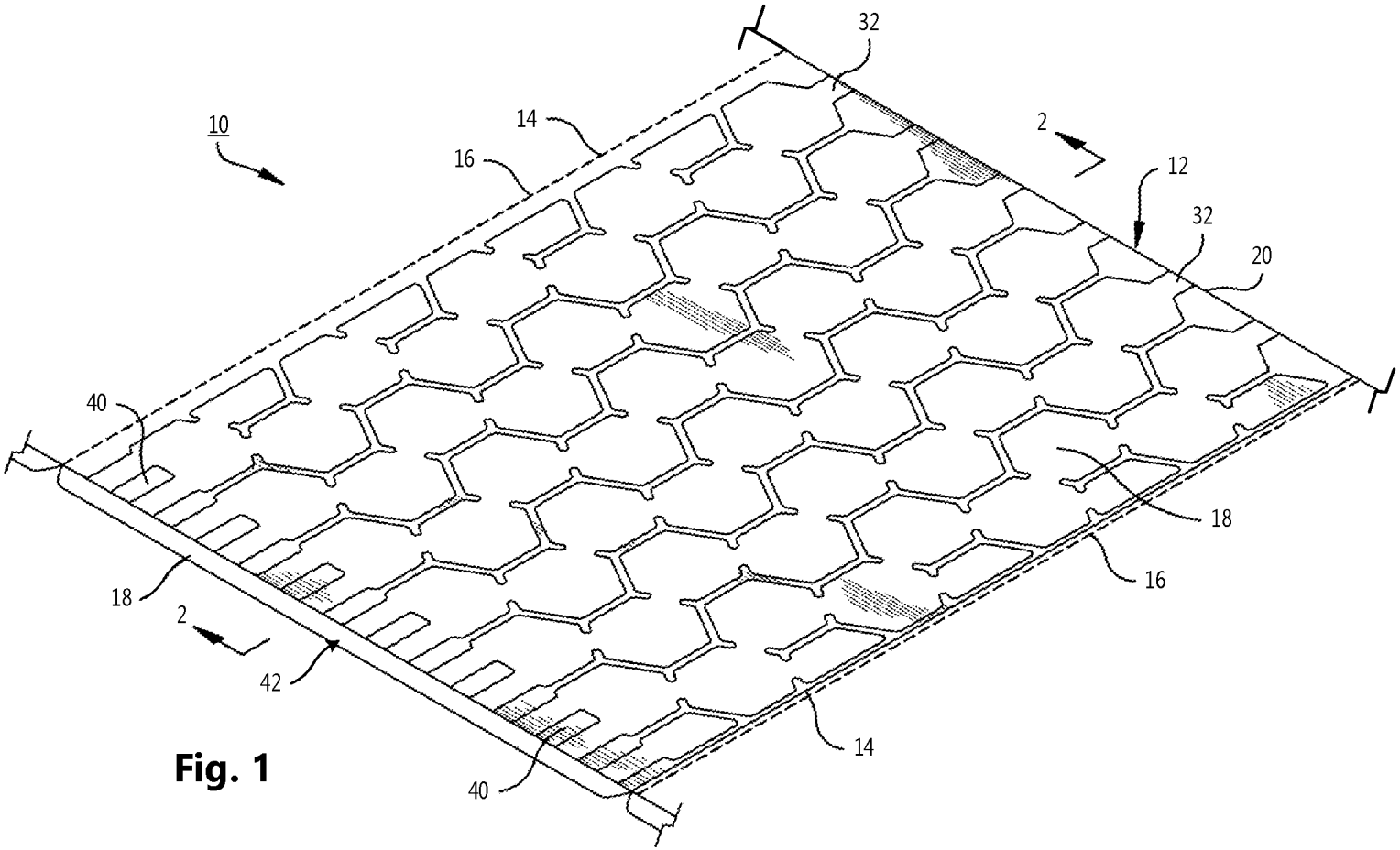
FIG. 1 is a perspective view of an exemplary embodiment of an inflatable packaging web.

This Detailed Description merely describes exemplary embodiments in accordance with the general inventive concepts and is not intended to limit the scope of the claims in any way. Indeed, the subject matter described by the claims is broader than and unlimited by the exemplary embodiments set forth herein, and the terms used in the claims have their full ordinary meaning.

The general inventive concepts will now be described with occasional reference to the exemplary embodiments disclosed herein. These general inventive concepts may, however, be embodied in different forms and should not be construed as limited to the embodiments set forth herein. Rather, these embodiments are provided so that this disclosure will be thorough and complete, and will fully convey the scope of the general inventive concepts to those skilled in the art.

Unless otherwise defined, all technical and scientific terms used herein have the same meaning as commonly understood by one of ordinary skill in the art encompassing the general inventive concepts. The terminology set forth in this Detailed Description is for describing particular embodiments only and is not intended to be limiting of the general inventive concepts. As used in this Detailed Description and the appended claims, the singular forms "a," "an," and "the" are intended to include the plural forms as well, unless the context clearly indicated otherwise.

Unless otherwise indicated, all numbers expressing quantities of ingredients, properties such as molecular weight, reaction conditions, percentages and so forth as used in the specification and claims are to be understood as being modified in all instances by the term "about." Accordingly, unless otherwise indicated, the numerical properties set forth in the specification and claims are approximations that may vary depending on the suitable properties sought to be obtained in embodiments described herein. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

Aspects of the present disclosure are directed to a method of producing on-demand inflatable packaging. The packaging would include a web of preformed pouches being defined by side edges and two panels. At least one panel has an inflation pattern and an outer skin is attached to the outside of the web. The packaging would be inflatable at a later time for assembly of a padded envelope, either with or without a product being deposited in the preformed pouch, and the product being deposited before or after the preformed pouch is inflated.

Aspects of the present disclosure are directed to an assembly of the on-demand inflatable packaging that allows the inflating of the padded envelope to be delayed, such as for example, until the end-user of the envelope deposits a product into the pouch. After the web is inflated, the padded envelope is separated from the web. This method allows more padded envelopes, in a non-inflated condition, to be shipped having a specific volume and weight, as compared to inflated padded envelopes. Also, a final user of the padded envelopes, such as a packer of a product, may produce only the amount of inflated padded envelopes needed for a certain packaging run, and thus enjoy the efficiencies of just-in-time production and reduction of envelope inventory.

The web of preformed pouches may be of a variety of forms in accordance with the embodiments disclosed herein. The web may be an inflatable cushioning material designed to be inflated initially, flattened, and re-inflated at a later time by an end user and used as a wrapping material. An exemplary material is FASTWRAP™, manufactured and marketed by Automated Packaging Systems of Streetsboro, Ohio, and described in U.S. Pat. No. 6,423,166, which is incorporated herein by reference in its entirety. The end user inflates this material on-demand and inflates only the amount of wrapping material that is required at that time. A method of producing the preformed pouches is discussed herein.

The outer skin may be made of any thin material of suitable strength. Exemplary materials for the outer skin include paper and plastic and the material may be printable. For example, a plastic skin may be imprinted with indicia, such as for example, trademark information, product measurements, instructions, and barcoding data. The outer skin remains sufficiently smooth after all manufacturing steps, such as for example, product loading, inflation, and sealing, so that the bar coding of the loaded, inflated package (i.e. the finished package) is readable by a scanner.

Aspects of the present disclosure are directed to various configurations of inflatable pouches that prevent the outer skin from becoming wrinkled over the inflatable pouch after inflation of one or more panels of the inflatable pouch. That is, inflation of an inflatable panel can cause the panels to shrink in the longitudinal and/or lateral directions (depending on the configuration of inflation pattern of the inflatable panel). In situations in which the outer skin is attached to the panels prior to inflation, the outer skin does not shrink with the inflated panel, which means the outer skin is larger than the inflated panel. If the outer skin is larger than the inflated panel, the outer skin can become wrinkled over the panel depending on how the outer skin is attached to the inflated panel. Various embodiments described herein are configured such the that the inflatable panel has minimal shrinkage after being inflated, and/or the outer skin is attached to the inflatable panel such that the shrinkage of the inflatable panel does not cause the outer skin to become wrinkled.

Aspects of the present disclosure are directed to a final packaging product. For exemplary purposes, a padded mailer envelope is discussed. However, it should be apparent to one with ordinary skill in the art that other packaging products can be used, such as, for example, paper or plastic bags, paper or plastic mailers, corrugate mailers, and other known packaging offerings in which the inside of the package may be lined with cushioning material.

Figure 2:
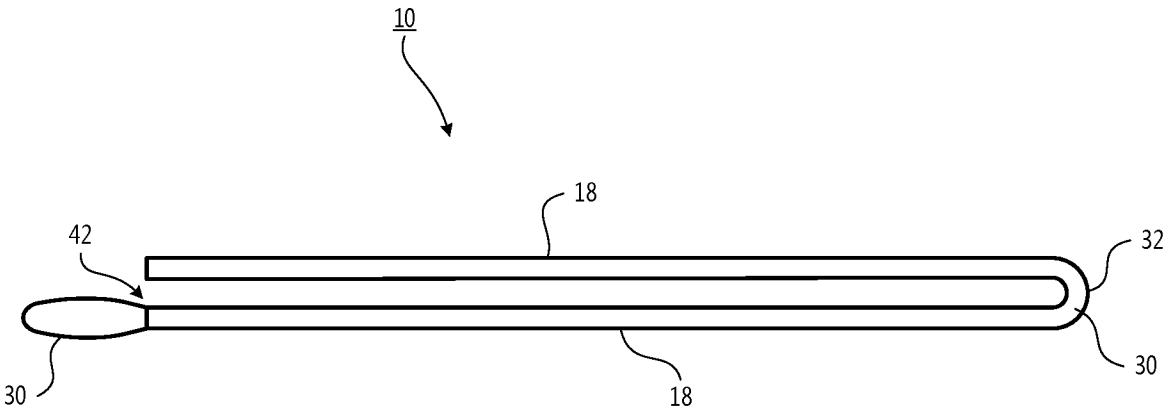
FIG. 2 is a sectional view of the packaging web of FIG. 1, shown along the line 2-2 of FIG. 1.

Referring now to the drawings, FIGS. 1 and 2 illustrate an exemplary embodiment of an inflatable packaging web 10. An exemplary web is made of one or more layers of plastic film. The packaging web 10 includes a string of side connected inflatable pouches 12. A single pouch is shown in FIG. 1, but the web 10 includes an indeterminate length of inflatable pouches 12. Each inflatable pouch in the web 10 is connected to one another at side edges 14. The exemplary side edges shown include lines of perforations 16 to facilitate separation of the finished product. Each pouch 12 includes at least one inflatable panel 18. The inflatable panel can take a wide variety of different forms. In some exemplary embodiments, the panels 18 can be made in a flat configuration and then later inflated and sealed. In other exemplary embodiments, the panels 18 may be at least partially inflated, at least partially flattened, and then later inflated and sealed. The panels may be made from the web disclosed in U.S. Pat. No. D596,031 or the web disclosed in U.S. Pat. No. 6,423,166, each of which are incorporated herein by reference in their entirety.

An exemplary web of on-demand inflatable packaging includes two or more pouches. Each pouch 12 can be formed by sealing a pair of panels 18 together along a bottom edge 20 and side edges 14 or by folding a larger panel in half along the bottom edge and sealing the side edges together. One or both of the panels include an inflation pattern 512 (see FIG. 5). One or both of the panels 18 include an inflation channel 30. The inflation channel allows the preformed pouch to be inflated by a nozzle inserted into the channel 30.

In the illustrated embodiment in FIG. 2, only one inflation channel 30 is included and the two panels of the pouch are in fluid communication, such that inflation of one of the panels inflates the other panel. For example, in the illustrated embodiment passages 32 connect the air pockets 34 (see FIG. 3) at the bottoms of the panels to one another such that inflation through the inflation channel 30 causes inflation of both panels. The inflation channel 30 may be as described by any one or more of U.S. Pat. Nos. 6,423,166; 8,357,439; and 8,038,348, each of which are incorporated herein by reference in their entirety.

Figure 3:
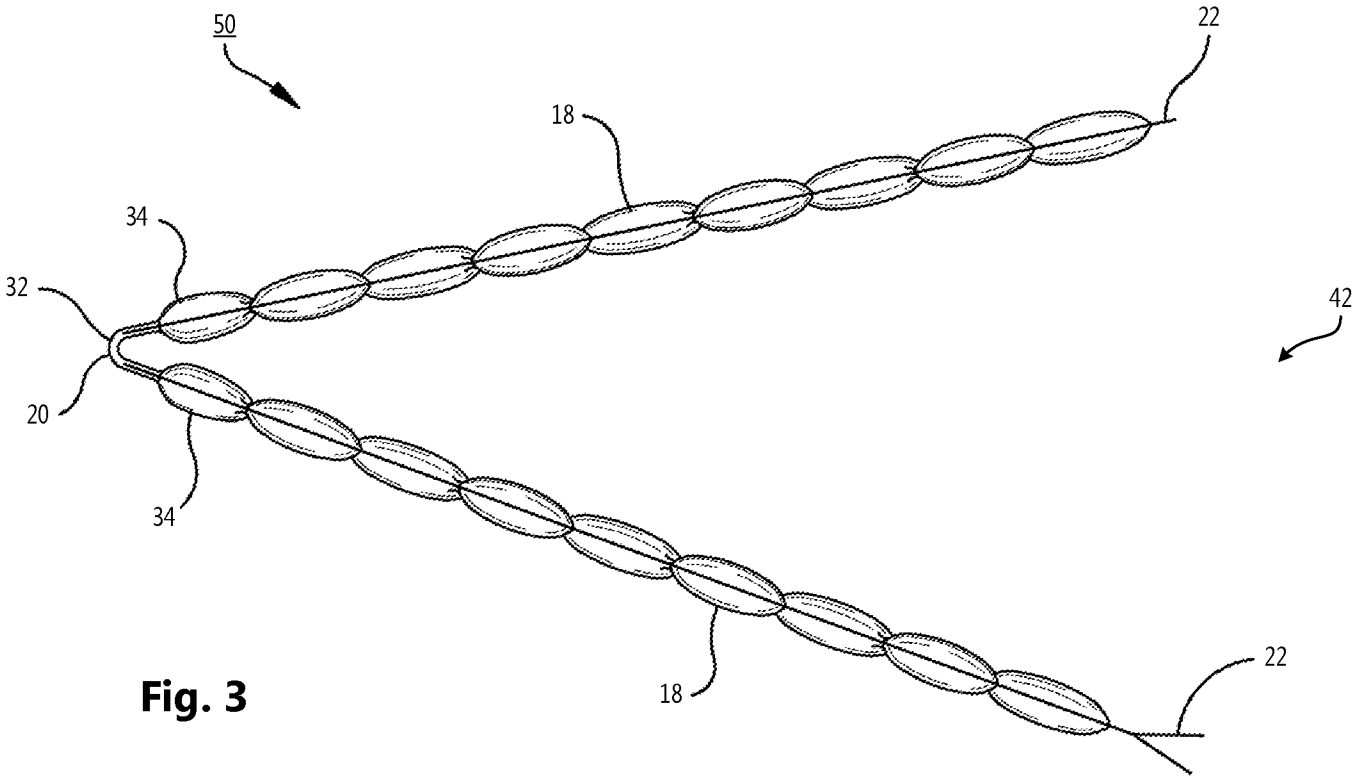
FIG. 3 is a side view of another exemplary embodiment of an inflatable packaging web, showing a pouch in an inflated condition.
Figure 4:
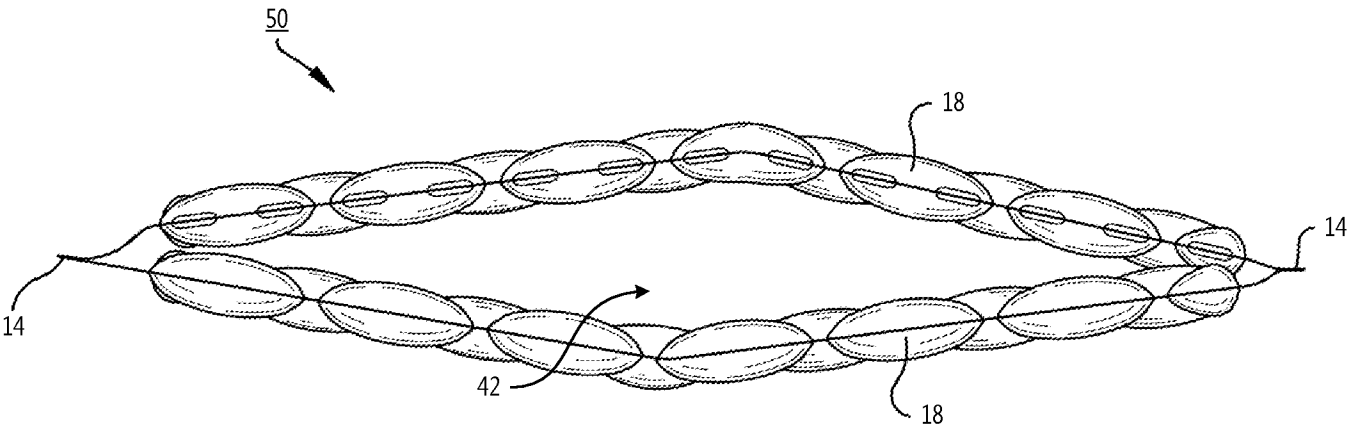
FIG. 4 is a side view of the pouch of FIG. 3, showing the pouch in a closed position.

The web of preformed pouches may be inflated to produce cushioning material. The pouch may be inflated and sealed in a first step to maintain the cushioning material, and then closed to create a closed pouch. For example, FIGS. 3 and 4 illustrate a pouch 12 of the web in an inflated condition. The web 10 is inflated through the inflation channel 30 and sealed across seals 40 to form the inflated pouches 50. The inflatable web of pouches 10 can be inflated and sealed in a wide variety of different ways. For example, the web 10 can be inflated and sealed in any one of the manners disclosed by U.S. Pat. Nos. 8,357,439, 8,038,348, 7,513,090 and Published Application No. 2009/029342, each of which are incorporated herein by reference in their entirety. As can be seen from FIG. 3, the panels 18 of the inflated pouch are connected (either by sealing or folding) at the bottom of the pouch. As can be seen from FIG. 4, the panels 18 are sealed together at the side edges 14 to close the inflated pouch 50.

Figure 5:
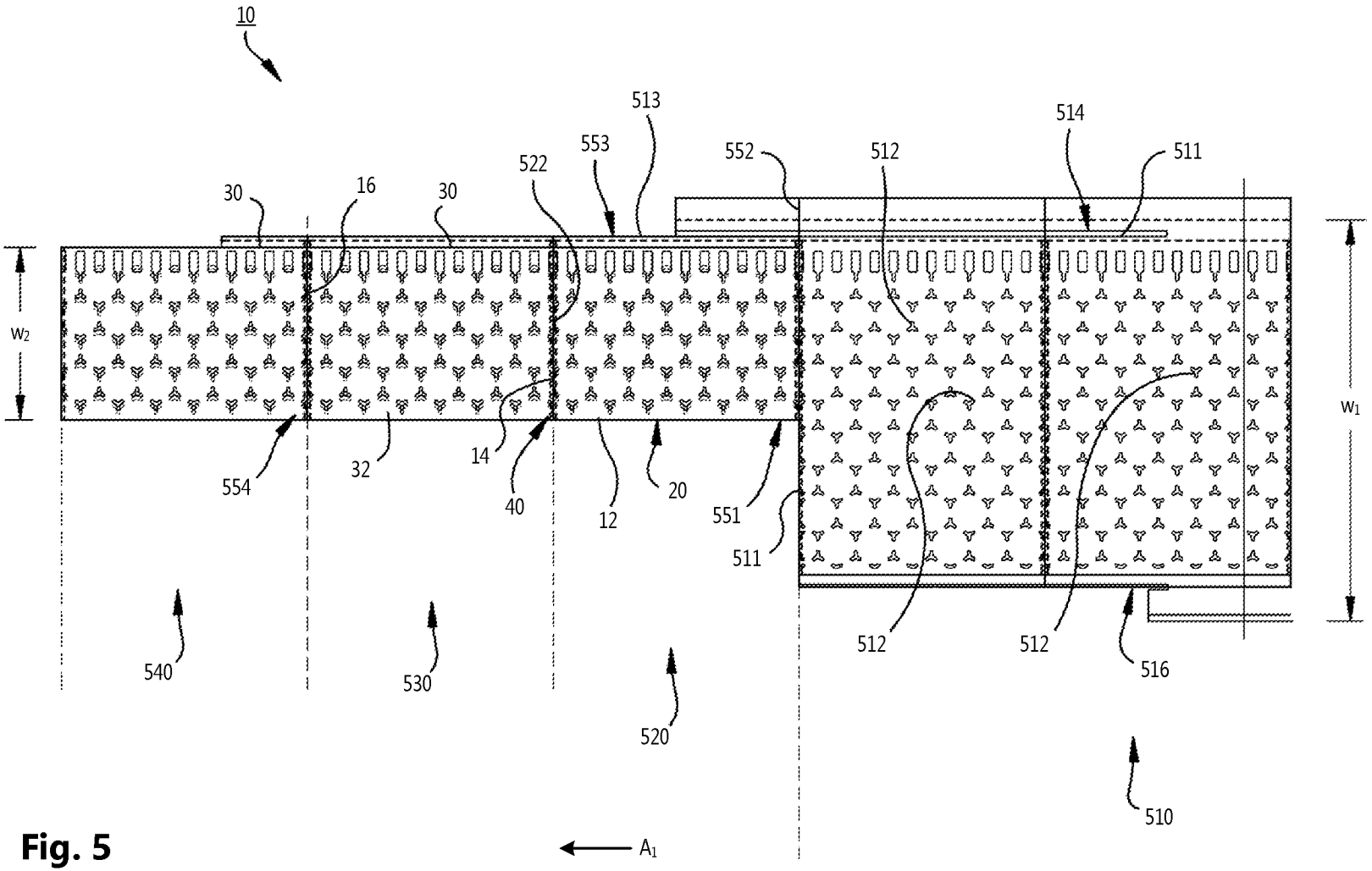
FIG. 5 is a top view of sequential assembly stages of a method to make an exemplary embodiment of an inflatable packaging web.

The web of inflatable pouches may be made from plastic film. An exemplary method for making the web 10 of inflatable pouches is illustrated in FIG. 5. At a first position 510, two single layers of material are placed on top of one another. The single layers may be plastic and, as shown, have a width W1. An exemplary width may be 20 inches, but any width may be used to accommodate a desired pouch width. The two layers may be of any of the web materials identified in any of the patents and published applications which are incorporated herein by reference. One or both of the layers may include an inflation edge line of perforations 511 that is spaced apart from the edge 513. The perforations 511 are useable to separate the preformed pouches after final assembly. Alternatively, the inflation edge line of perforations could be in line with the edge 513 or omitted. Also at position 510, the two layers are sealed together according to the seal and inflation pattern 512. In the example illustrated by FIG. 5, the seal pattern having a hexagon cell pattern and shown in FIG. 1 is used. However, any inflation pattern can be used. The layers are also sealed together at top and bottom ends as indicated by arrows 514, 516, respectively. A registration perforation 552 is used for registering the two layers prior to a folding operation. In another exemplary embodiment, the illustrated single layer of inflatable material formed at position 510 is replaced with material formed in accordance with U.S. Pat. No. 6,423,166.

At position 520, the material formed at position 510 (or material formed as described in U.S. Pat. No. 6,423,166) is folded approximately in half on a fold line 551 to form a bottom edge 20 of the pouch. Cross seals 522 are formed through the four layers (two layers from the top set of layers and two layers from the bottom set of layers) to form the pouches 12. Also at position 520, a trim line 553 may be added, for example, by hot knife, to remove excess material.

The web may be inflated at the next position 530. A line of perforations 554 can be added to allow for separation after final assembly steps. In one embodiment, the web of inflatable pouches 10 may be shipped to a site where items are packaged. The web of inflatable pouches 10 can be shipped in a variety of different ways. For example, the web of inflatable pouches 10 can be packaged (e.g., rolled up or folded into a box).

At that site, the web 10 may be inflated after packaging of the product to form inflated pouches. In some embodiments, the pouch may alternatively be loaded with a product after the inflation and sealing that maintains inflation. The top of the pouch is sealed after any product is loaded. Following position 530, position 540 represents a different location where the web 10 is inflated and sealed to maintain the inflation of the pouches 50. For example, the web 10 can be inflated and sealed to maintain inflation of the pouches in any one of the manners disclosed by U.S. Pat. Nos. 8,357,439, 8,038,348, 7,513,090 and Published Application No. 2009/029342.

Figure 6B:
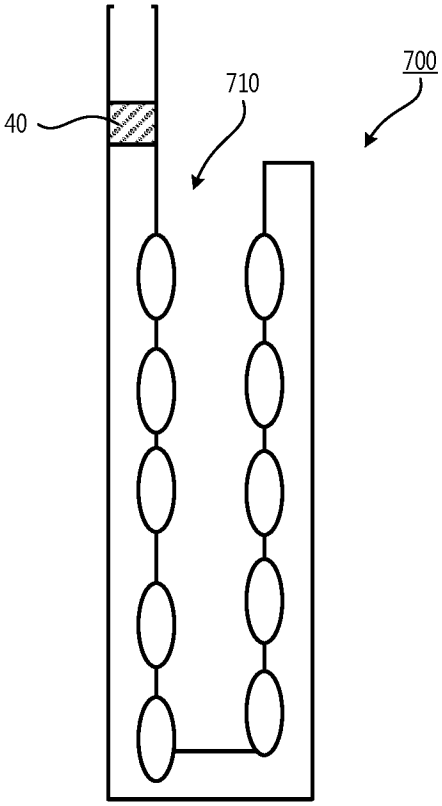
FIG. 6B is a sectional view of the pouch of FIG. 6A, showing the pouch in a sealed condition.
Figure 6A:
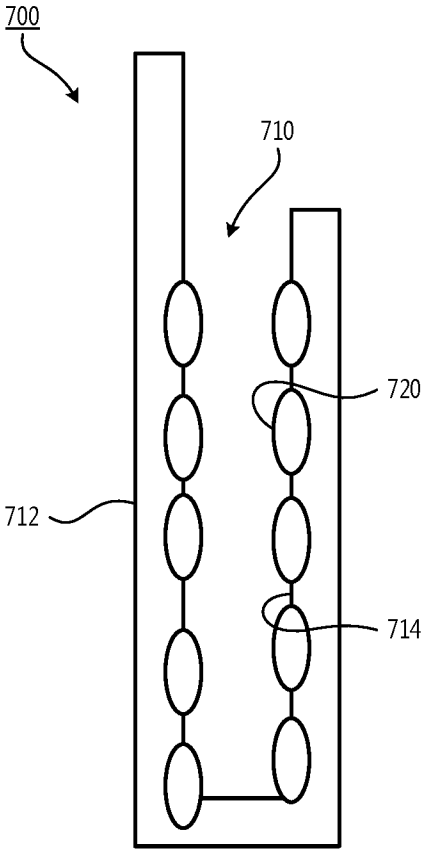
FIG. 6A is a sectional view of another exemplary embodiment of an inflatable packaging web, showing a pouch in an inflated condition.

Another exemplary embodiment of a packaging web is shown in FIGS. 6A and 6B. The embodiment illustrated is similar to the embodiment illustrated by FIGS. 1 and 2. As illustrated, a separate outer skin is not used. In FIG. 6A, the inflatable packaging web 700 has been formed by two layers, an outside layer 712 and an inside layer 714, to form an opening 710. The inside layer has a pattern of inflated cells 720 formed by an inflation process, as discussed herein. The outside layer 712 is relatively smooth and unaffected by the inflation process.

In FIG. 6B, the seals 40 are closed to maintain the inflation in the pouch. As discussed herein, the panels may be made from the web disclosed in U.S. Pat. No. D596,031 or the web disclosed in U.S. Pat. No. 6,423,166, each of which are incorporated herein by reference in their entirety.

Figure 7:
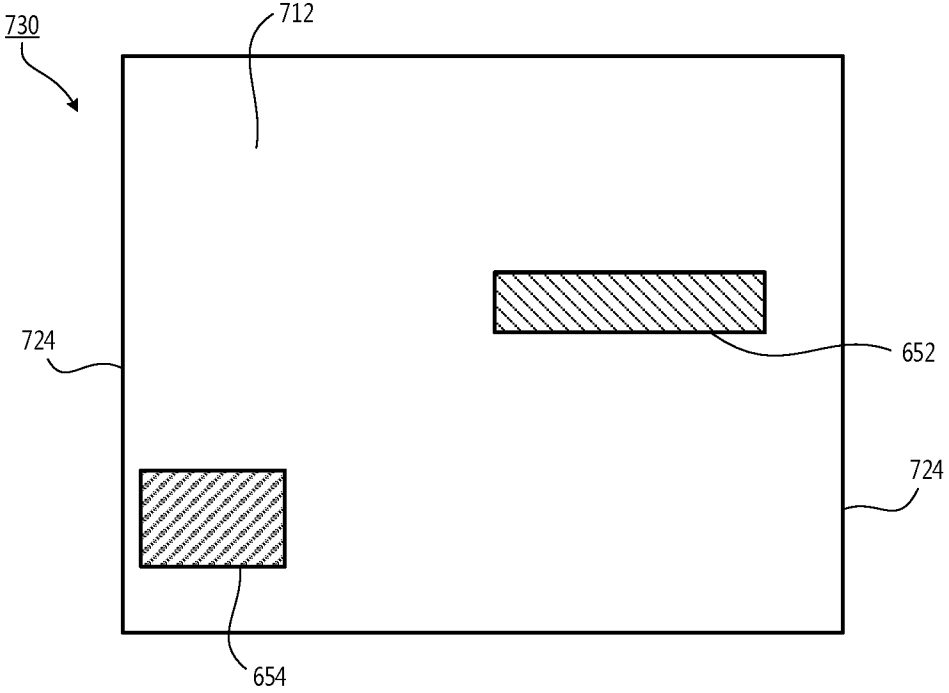
FIG. 7 is a front view of the pouch of FIG. 6B, showing bar code data and indicia imprinted on the pouch.

In FIG. 7, only a single pouch of the packaging web 700 is shown. The pouch 730 is defined in part by side edges 724. As discussed, the outside layer 712 is relatively smooth and unaffected by the inflation process. The outside layer 712 includes imprinted information on the relatively smooth surface, such as for example, bar code data 654 and/or packaging indicia 652.

In an embodiment, the web may include an outer skin separate from the inflation layers. The outer skin may be made of any thin material of suitable strength, such as for example, paper or plastic, and the material may be printable. In one exemplary embodiment, information, such as shipping address, product details, bar code, QR code, or other scannable/computer readable information, is printed directly on the outer skin, rather than to a label that is affixed to the outer skin. The outer skin remains sufficiently smooth after all packaging steps, such as for example, product loading, panel inflation, and sealing, so that the information, such as shipping address, product details, bar code, QR code, or other scannable/computer readable information is readable by a scanner. The outer skin may be sealed on all four sides around the perimeter of the preformed pouch. If the end user of the on-demand inflatable packaging produces packaging as an end product, such as for example, a padded mailer envelope, the outer skin may be sealed on only three sides around the perimeter of the envelope to allow for depositing of a product. The open side may include user sealable features, such as for example, a removable strip which temporarily protects an adhesive strip.

Figures 8A, 8B, 8C:
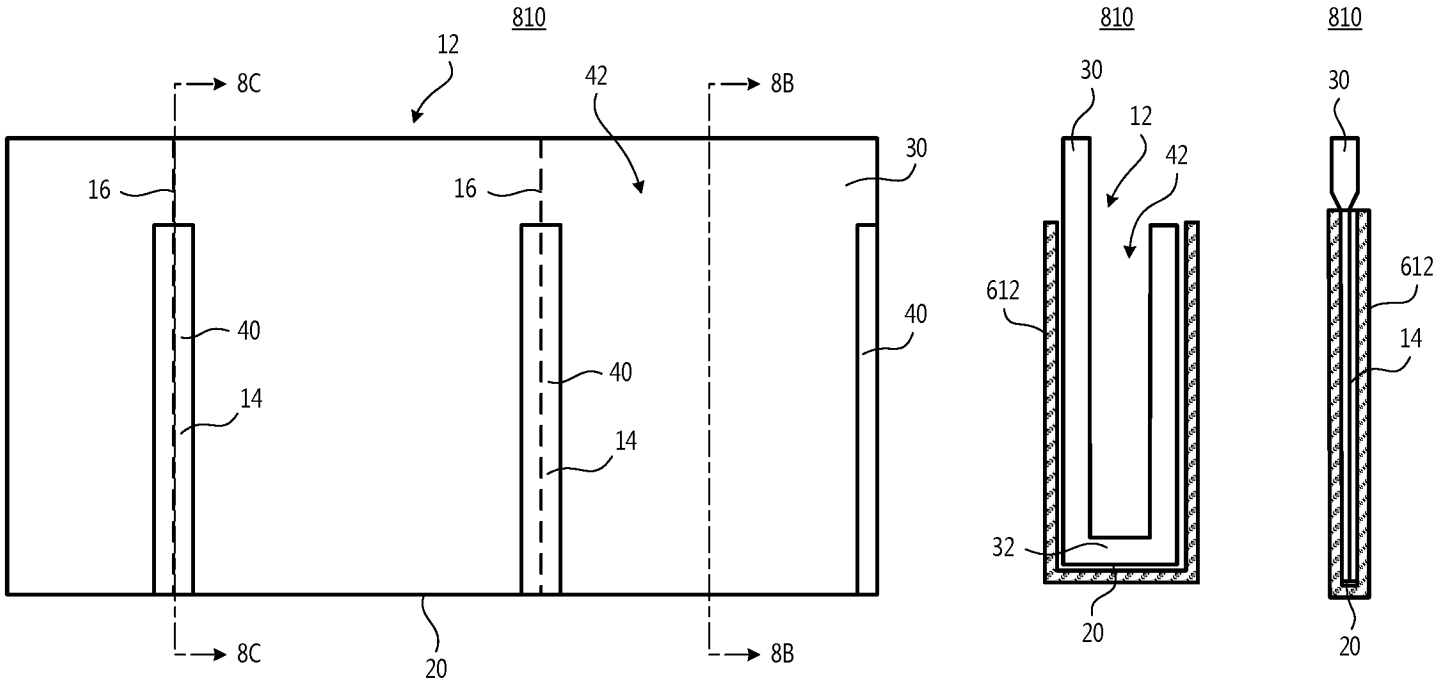
FIG. 8A is a front view of another exemplary embodiment of an inflatable packaging web.
FIG. 8B is a sectional view of the inflatable packaging web of FIG. 8A, shown along the line 8B-8B of FIG. 8A.
FIG. 8C is a sectional view of the inflatable packaging web of FIG. 8A, shown along the line 8C-8C of FIG. 8A.

An embodiment of a packaging web having an outer skin will now be discussed. The packaging web 810 shown in FIGS. 8A-11B has an outer skin 612. FIG. 8A is a top view of inflatable packaging web 810, a sectional view of the inflatable packaging web 810 is shown along the center of a pouch in FIG. 8B, and a sectional view of the inflatable packaging web 810 is shown along the side edge of a pouch in FIG. 8C.

The embodiment illustrated in FIGS. 8A-8C is similar to the embodiment illustrated by FIGS. 6A and 6B, except the packaging web 810 includes an outer skin 612. The outer skin 612 may be provided around the entire web as shown or adhered to one or both of the panels 18. The packaging web 810 includes a string of side connected inflatable pouches 12 with the outer skin 612 disposed around the pouches 12. Each pouch 12 includes at least one inflatable panel 18. The inflatable panel can take a wide variety of different forms. In exemplary embodiments, the panels 18 are made from the web disclosed in U.S. Pat. No. D596,031 or the web disclosed in U.S. Pat. No. 6,423,166, each of which are incorporated herein by reference in their entirety, or any other inflatable web. Each pouch 12 is formed by sealing a pair of panels 18 together along a bottom edge 20 and side edges 14 or by folding a larger panel in half along the bottom edge and sealing the side edges together.

Referring now to FIGS. 8B and 8C, sectional views of the packaging web 810 of FIG. 8A are shown. In the illustrated embodiment, outer skin 612 is only connected to the panels at the side edges 14, preferably by the seals 40. This structure may be the case when the outer skin 612 is disposed completely around the pouches 12 as shown, when the outer skin is connected to one side of the web, but not to the other, or when separate skins are attached to opposite sides of the web 810. By attaching the outer skin 612 to the web along the side edges 14, the outer skin will wrinkle less when the pouches are inflated, as compared to a skin that is attached to the entire surface(s) of the web 810. The outer skin 612 attached in this manner will not wrinkle significantly, if the web is made from a vacuum process as disclosed in U.S. Pat. No. 6,423,166. In the illustrated embodiment, the outer skin 612 is attached to the panels 18 along an entire height of the side edges 14 of the panels (excluding the inflation channel 30) by seals 40. In other embodiments, the outer skin 612 is attached to the panels 18 along only a portion of the side edges 14. In some embodiments, the outer skin 612 is attached, adhered, or bonded to an entire surface or substantially all of the surface of the panels.

One or both of the panels 18 include an inflation channel 30. In the illustrated embodiment, only one inflation channel 30 is included and the two panels of the pouch are in fluid communication, such that inflation of one of the panels inflates the other panel. For example, in the illustrated embodiment in FIGS. 8A-8C, passages 32 connect the air pockets 34 at the bottoms of the panels to one another such that inflation through the inflation channel 30 causes inflation of both panels. The inflation channel 30 may be as described by any one or more of U.S. Pat. Nos. 6,423,166; 8,357,439; and 8,038,348, each of which are incorporated herein by reference in their entirety.

Figure 10:
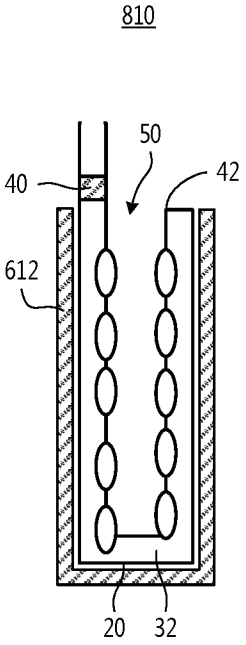
FIG. 10 is a sectional view of the pouch of FIG. 9, showing the pouch in an inflated condition with the panel sealed.
Figure 9:
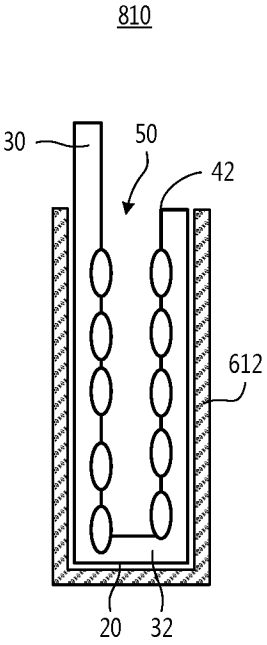
FIG. 9 is a sectional view of the inflatable packaging web of FIG. 8A, showing a pouch in an inflated condition.

An exemplary inflation of the web 810 is illustrated in FIGS. 9-11B. Referring now to FIG. 9, the web 810 is inflated through the inflation channel 30. As shown in an inflated condition, the cushioning bubble pattern of the pouches is opened by inflation on the inward side of the pouch. FIG. 10 illustrates that one of the panels is sealed across seals 40 to form and seal the inflated pouches 50 inside the outer skin 612. The inflatable web of pouches 810 can be inflated and sealed in a wide variety of different ways. For example, the web 10 can be inflated and sealed in any one of the manners disclosed by U.S. Pat. Nos. 8,357,439, 8,038,348, 7,513,090 and Published Application No. 2009/029342.

Figure 11A:
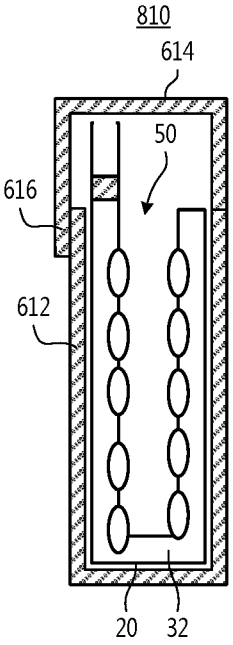
FIG. 11A is a sectional view of another exemplary embodiment of an inflatable packaging web, showing a pouch in an inflated condition with the panel sealed and with the skin closed.

Referring to FIG. 11A, in one exemplary embodiment, the outer skin 612 is longer on one side of the pouch to form a sealing flap 614. The inflated pouch 50 may be loaded with a product, either by a packer or a consumer, the sealing flap 614 is moved to a closed position on an opposing side of the pouch, and the sealing flap 614 is positioned to seal the package at an overlap position 616. Other sealing structure for the outer skin may be used in other embodiments of packaging webs, such as for example, two flaps on each side of the pouch of equal length that are joined together, such as for example, by a strip of adhesive on an inward side of at least one flap.

Figure 11B:
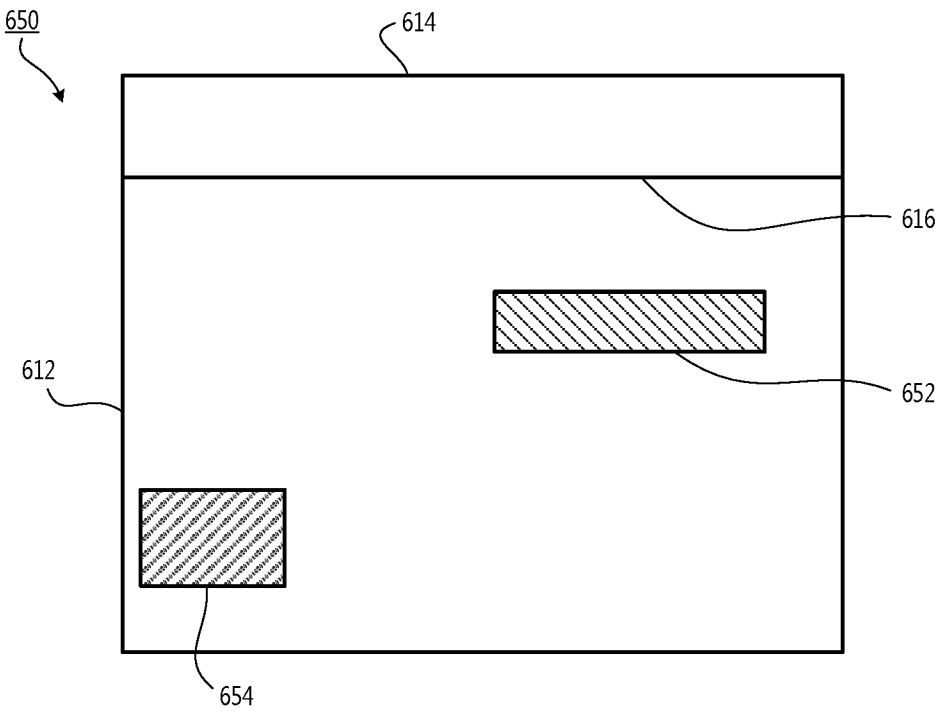
FIG. 11B is a front view of the pouch of FIG. 11A, showing bar code data and indicia imprinted on the pouch.

FIG. 11A depicts a sectional view of one package of the web and FIG. 11B depicts an outer view of the one package in the state shown in FIG. 11A. The package 650 includes an outer skin 612 and the sealing flap 614, which is positioned to seal the package 650 at an overlap position 616. Bar code data 654 and product indicia 652 are imprinted directly onto the outer skin 612. The imprinting operation may take place before or after inflation of the web, and before or after depositing of product by a packer.

Another exemplary embodiment of a packaging web is illustrated in FIGS. 12-20. The exemplary packaging web shown in FIGS. 12-20 is similar to the embodiment illustrated by FIGS. 6-8, except the outer skin is sealed to close the pouch before final inflation of the web. The web may be at least partially inflated before the outer skin is sealed. If so, the web may be partially flattened prior to sealing the outer skin.

Figure 14:
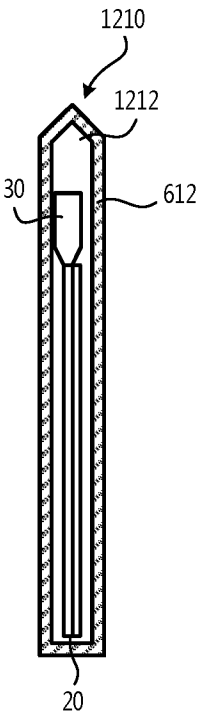
FIG. 14 is a sectional view of the inflatable packaging web of FIG. 12, shown along the line 14-14 of FIG. 12.
Figure 13:
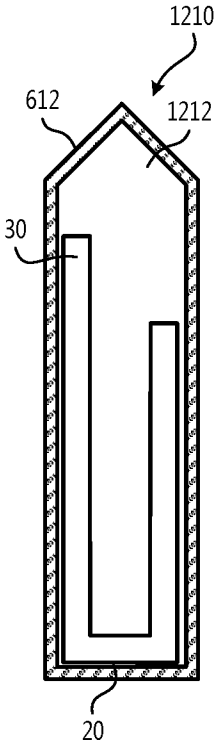
FIG. 13 is a sectional view of the inflatable packaging web of FIG. 12, shown along the line 13-13 of FIG. 12.
Figure 12:
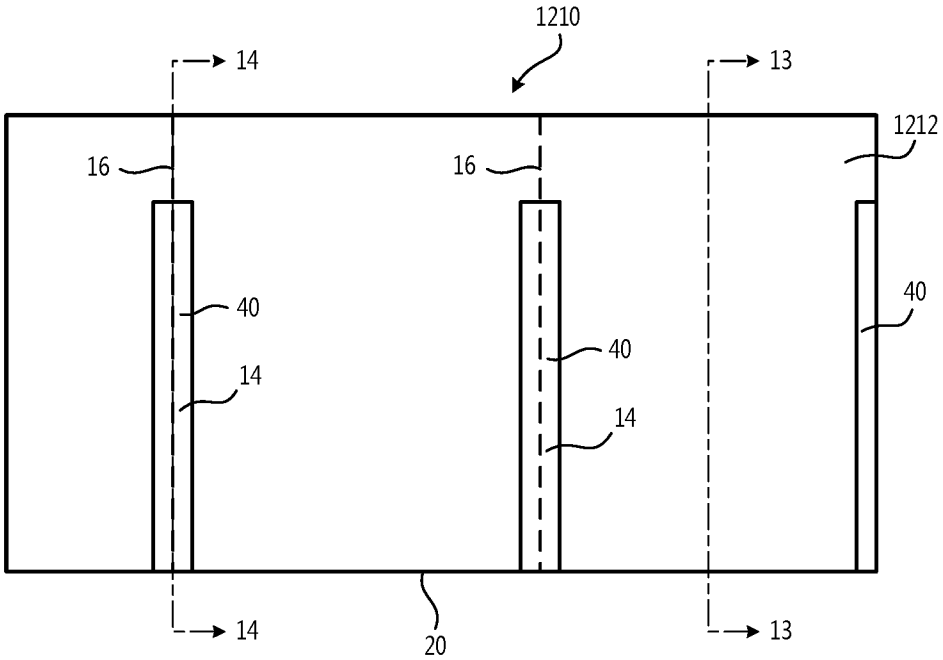
FIG. 12 is a front view of another exemplary embodiment of an inflatable packaging web.

In the embodiment illustrated in FIGS. 12-14, a top edge of the outer skin 612 is connected to form an enclosed channel 1212, as shown in FIGS. 13 and 14. In FIG. 13, the inflatable packaging web 1210 is shown along the middle of a pouch. In FIG. 14, the inflatable packaging web 1210 is shown along the edge line 14 of the pouch. In a non-inflated and stored configuration, the entire web can be completely flat or can be at least partially flattened.

Depositing a product in the preformed pouches of the web will now be discussed. A product may be deposited into the pouch in several different ways. For example, the product may be inserted into the open end of the pouch, either by manual or by automated techniques. The product can be inserted into the open end before the pouch is inflated and sealed. Alternatively, the product can be inserted into the pouch through the open end and the pouch is inflated and sealed. A packer may select one of these options, in view of the product size, weight, or other characteristics.

Figure 21A:
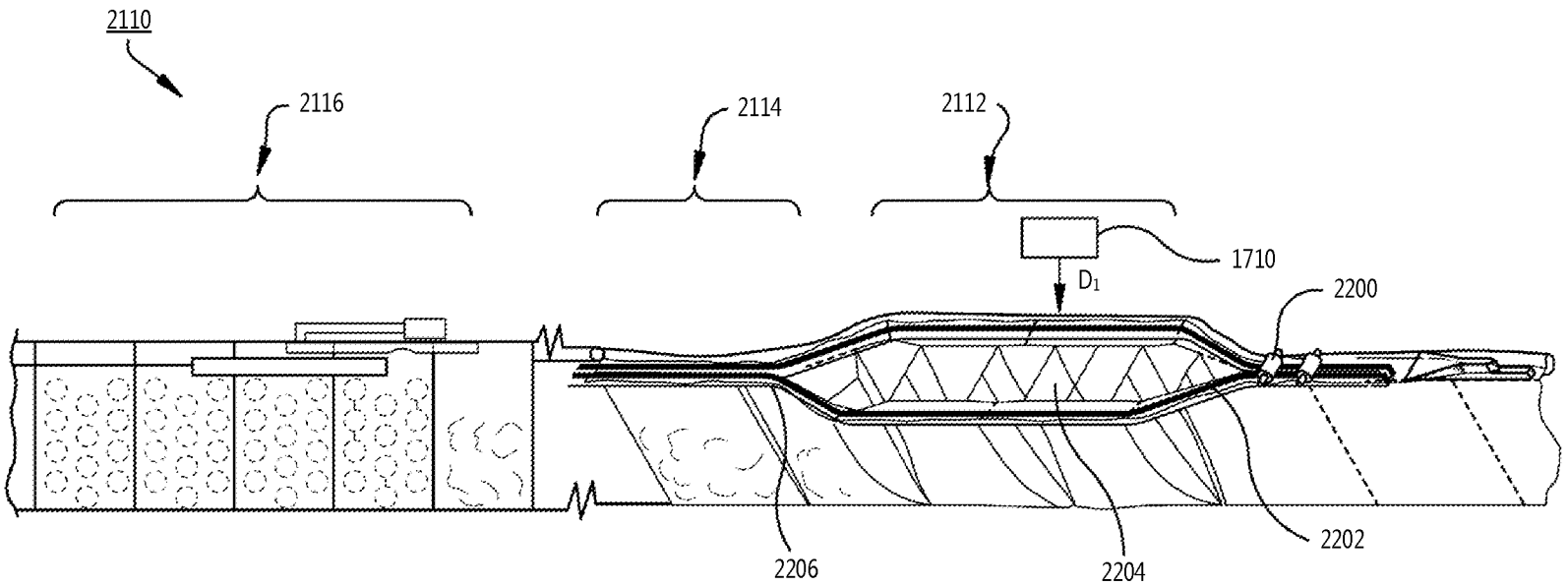
FIG. 21A is a front perspective view of a packaging machine, showing exemplary machinery for forming and packaging a padded package from an inflatable packaging web.
Figure 21B:
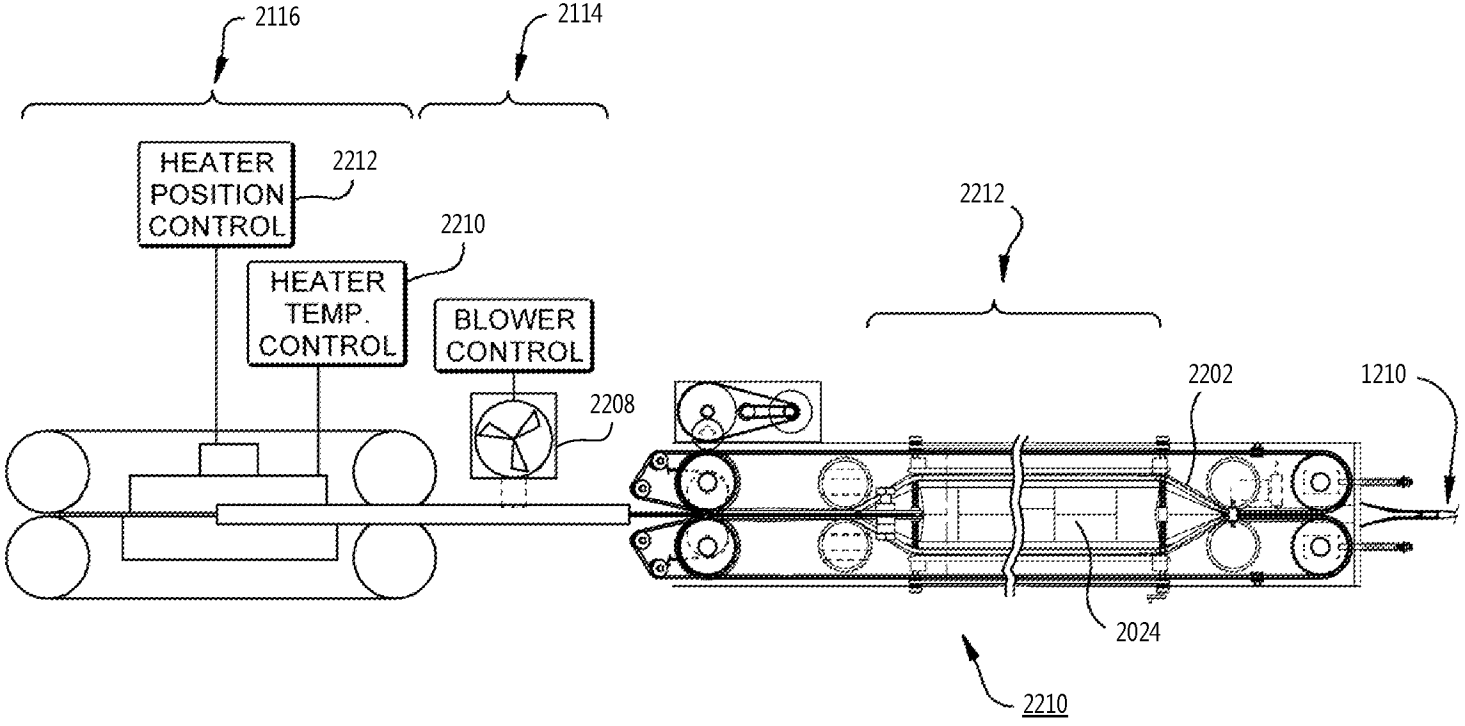
FIG. 21B is a top view of a packaging machine of FIG. 21A.

The exemplary skin configuration of FIGS. 12-14 allows the packaging web 1210 to be opened, loaded, closed and sealed by a packaging machine, such as the packaging machine 2110 illustrated in FIGS. 21A and 21B. Examples of packaging machines that can be modified, or combined, to open, load, close, and seal the outer skin are described in U.S. Pat. Nos. 7,552,571; 6,170,238; 6,055,796; 5,996,319; 5,987,856; and 5,944,424, and US Publication No. 2012/0214658, each of which are incorporated herein by reference in their entirety. Other outer skin configurations may be used to load, close and seal a padded package by a packaging machine.

In one exemplary embodiment, a bagging machine is used to load, close and seal a padded package. In this example, the pouch is loaded with a product, and the outer skin is sealed. For example, the pouch, loaded with a product, may be placed in a mailing bag. In one exemplary embodiment, a pouch loaded with a product is placed in a bag and the bag is sealed with a bagging machine. For example, a pouch loaded with a product may be bagged using any one of the machines disclosed by U.S. Pat. Nos. 8,3076,617; 7,7552,257; 6,948,296; 6,742,317; 6,543,201; 6,055,796; 5996,319; 5,987,856; 5,944,424 and 6,170,238, each of which are incorporated herein by reference in their entirety.

Figure 17:
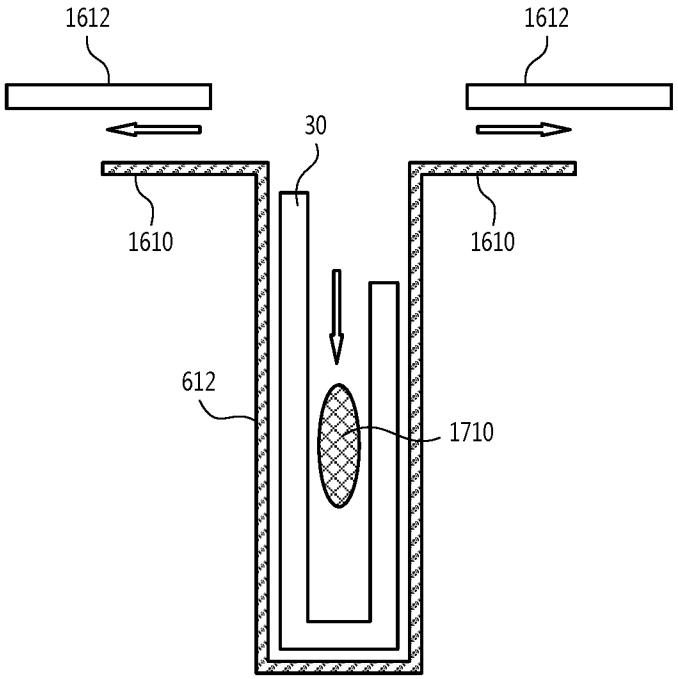
FIG. 17 is a sectional view of the inflatable packaging web of FIG. 13, showing a product inserted inside.
Figure 16:
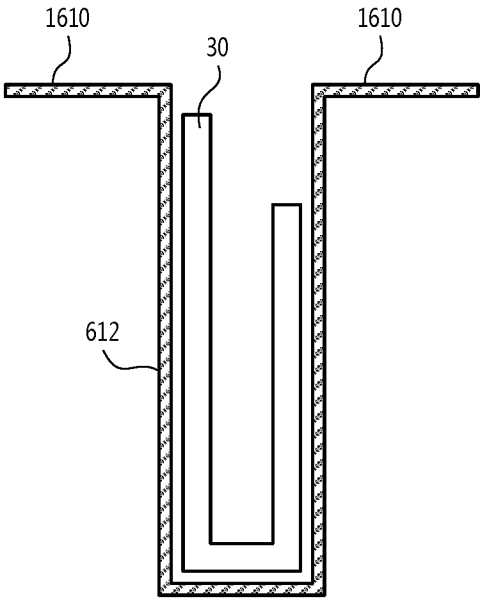
FIG. 16 is a sectional view of the inflatable packaging web of FIG. 13, showing the sealed skin in a slit condition and the skin flaps folded open.
Figure 15:
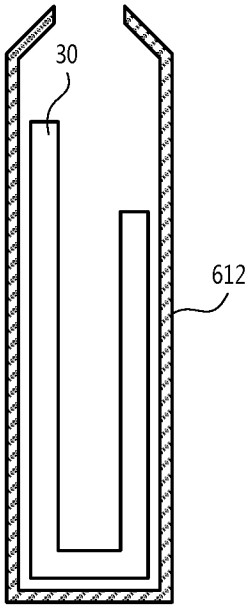
FIG. 15 is a sectional view of the inflatable packaging web of FIG. 13, showing the sealed skin in a slit condition.

Another exemplary method of using an inflated packaging web to package a product will now be discussed. FIGS. 15-20 illustrate a method of forming an inflated/padded package 1500 from the web 1210 with the packaging machine. Referring to FIG. 15, a top of the outer skin 612 is cut, slit, or otherwise separated. The machine makes the slit, cut, or other separation in the same manner as is disclosed in U.S. Pat. Nos. 7,552,571; 6,170,238; 6,055,796; 5,996,319; 5,987,856; or 5,944,424. Referring to FIG. 16, top lips 1610 are formed and grabbed by belts 1612. The belts travel the same direction as the web and act to pull the web in the forward direction through the machinery. The belts 1612 may have the same form disclosed by U.S. Pat. Nos. 7,552,571; 6,170,238; 6,055,796; 5,996,319; 5,987,856; or 5,944,424. Referring to FIG. 17, the belts 1612 pull the lips apart to open the pouch. A product 1710 is deposited into the pouch. The depositing of the product may be done by automated machinery or manually by hand.

Figure 20:
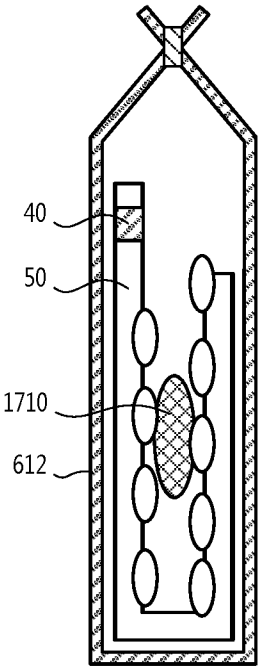
FIG. 20 is a sectional view of the inflatable packaging web of FIG. 19, showing the skin flaps closed.
Figure 19:
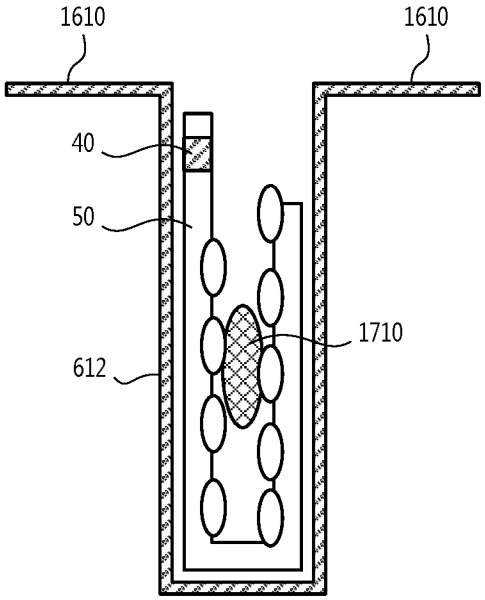
FIG. 19 is a sectional view of the inflatable packaging web of FIG. 18, showing the web in an inflated condition and the panel sealed.
Figure 18:
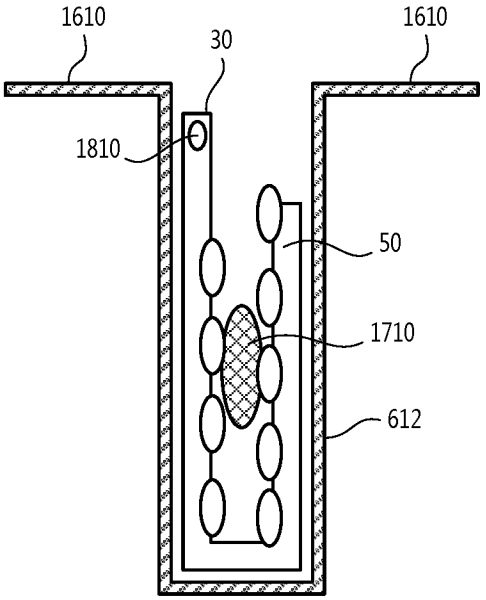
FIG. 18 is a sectional view of the inflatable packaging web of FIG. 17, showing the web in an inflated condition.

FIGS. 18-20 illustrate an exemplary process for finishing the packaging of a product. FIG. 18 is a sectional view showing the web 1210 being inflated around a product 1710. The web may be inflated by an inflation nozzle 1810 into a inflation channel 30. FIG. 19 depicts a sectional view showing the web 1210 after inflation, where the web has been sealed to maintain the inflation. FIG. 20 illustrates the flaps 1610 of the outer skin in a sealed position. Once the web 1210 reaches this condition, the individual packages may be separated from the web, such as for example, by separating at edge perforations.

Referring to an exemplary embodiment illustrated in FIGS. 21A and 21B, the packaging machine 2110 includes several stations. Each station performs one or more particular purposes as the web travels through each station. For example, the packaging machine 2110 includes a load station 2112, an inflation and sealing station 2114, and a skin sealing station 2116. It will be apparent to one skilled in the art that packaging machine 2110 is offered for exemplary purposes only, and that other embodiments of packaging machines can be used, or with a combination of packaging machines and one or more manual assembly steps can be used.

Referring to FIG. 21A, a packaging web 1210 is moved along a path of travel toward a load station 2112. The load station is used to deposit automatically or manually one of more pieces of product into each pouch of the web 1210. At the beginning of the load station, or upstream from it, the enclosed channel 1212 (see FIGS. 13-15) is cut open. At a separation point 2220, the flaps 1610 are engaged and pulled apart by belts, which also pull the web through the machinery. The outsides of the web travels outward along an angled path 2202 prior to a loading point. The load station 2112 may correspond to a load station disclosed in U.S. Pat. Nos. 7,552,571; 6,170,238; 6,055,796; 5,996,319; 5,987,856; or 5,944,424.

The load station 2112 includes a length of travel in which the two panels are held apart a distance. In the length of travel, a loading cavity 2204 is created in between the panels of each pouch. As shown in FIGS. 21A and 21B, the product 1710 is deposited in a direction D1 into the loading cavity by load station 2112. As discussed herein, the loading may be by automated machinery or by a manual step. At the end of the loading station 2112, the sides of the panel are brought back together to be contiguous or relatively contiguous at a pre-sealing point 2206.

The web travels on to the next station to be inflated and sealed. In an exemplary embodiment, inflation and sealing components 2114 correspond to inflation and sealing components disclosed by U.S. Pat. Nos. 8,357,439, 8,038,348, 7,513,090 and/or Published Application No. 2009/029342 and are provided after the load station 2112. The web includes a channel for the pouches to be inflated. Referring specifically to FIGS. 18 and 21, the channel 30 is routed onto a pin which includes an inflation nozzle 1810. The pin and inflation nozzle 1810 slides into the channel as the web travels through the machinery and inflates the pouch around the product by a blower 2208. The pouch is then sealed along the seals 40 to maintain inflation of the pouch. This sealing may be performed by sealing belts that have the configuration of sealing belts disclosed by U.S. Pat. Nos. 7,552,571; 6,170,238; 6,055,796; 5,996,319; 5,987,856; or 5,944,424. In one exemplary embodiment, the pouches of the web are vacuum formed, such as for example, by using the material disclosed by U.S. Pat. No. 6,423,166.

In the illustrated embodiment, a skin sealing station 2116 is positioned after the inflation and sealing components 2114. Still referring to FIGS. 21A and 21B, the outer skin is sealed by sealing belts. The sealing is controlled by a heater temperature control 2210 and a heater position control 2212. The sealing belts may have the configuration of the sealing belts of U.S. Pat. Nos. 7,552,571; 6,170,238; 6,055,796; 5,996,319; 5,987,856; and/or 5,944,424.

In another exemplary embodiment, the sealing of the pouches and the sealing of the skins is accomplished with a single seal. For example, after inflation of the pouches a single sealer seals across all four layers, including the two layers at the end of the pouch and two layers of the skins 1610, at the same time. In one exemplary embodiment, the skin sealing station 2116 corresponds to a closure and sealing station disclosed by U.S. Pat. Nos. 7,552,571; 6,170,238; 6,055,796; 5,996,319; 5,987,856; and/or 5,944,424.

Figure 22:
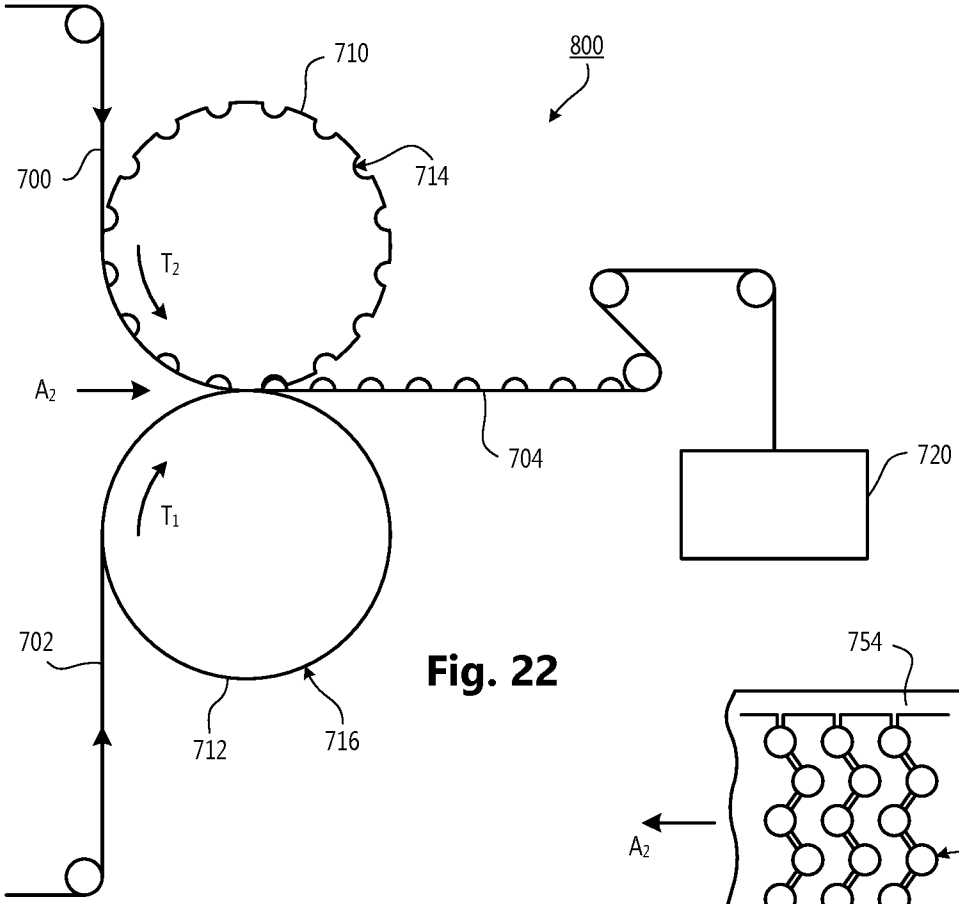
FIG. 22 is a schematic view of a process of forming inflatable cushioning material.

A machine and method for producing inflatable material is illustrated in FIG. 22. The method is useable for forming re-inflatable material that can be used to produce cushioning material in any of the embodiments disclosed by this application. As discussed, the web of preformed pouches may be of a variety of forms in accordance with the embodiments described herein. The web may be an inflatable cushioning material designed to be inflated at a later time by an end user. An exemplary material is described in U.S. Pat. No. 6,423,166. The end user may inflate this material on-demand and the end user may inflate only the amount of wrapping material that is required at that time.

Still referring to FIG. 22, a machine 800 is arranged to produce an inflatable cushioning material. The machine includes two adjacent wheels, a base wheel 712 rotating in a direction T1 and a forming wheel 710 rotating in an opposite direction T2. Two individual layers of plastic film 700, 702 are pulled in a direction A2 between the two wheels 710, 712. The forming wheel 710 has a patterned surface 714 to produce an inflatable pattern on the web 704. The base wheel 712 may have a smooth surface 716. The inflatable cushioning material may be stored in bulk amounts in a container 720 in an uninflated state until an end-user is ready to use the material. Another machine or series of machines can be attached the outer skin and inflate the cushioning material in an amount desired.

Figure 23:
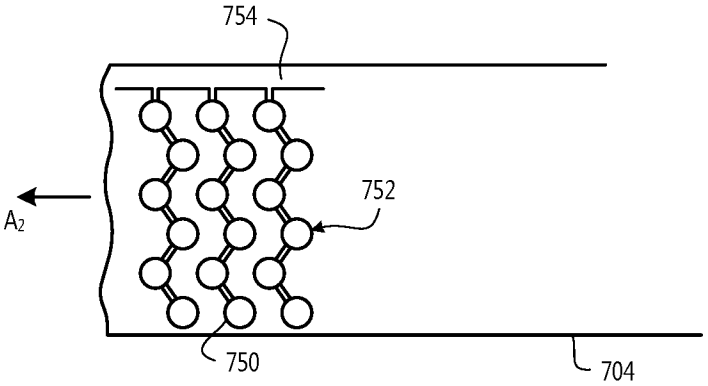
FIG. 23 is a front view of a web of inflatable cushioning material being produced by the process of FIG. 22.

A top view of the web 704 of inflatable cushioning material is shown in FIG. 23. The web includes an inflation pattern 750 which includes repetitive columns of interconnected cells 752 arranged in an alternating pattern. After an inflation process, such as by vacuum, the cells may have a distinguishable shape, such as for example, hexagonal, round, oval, etc.

Figure 24A:
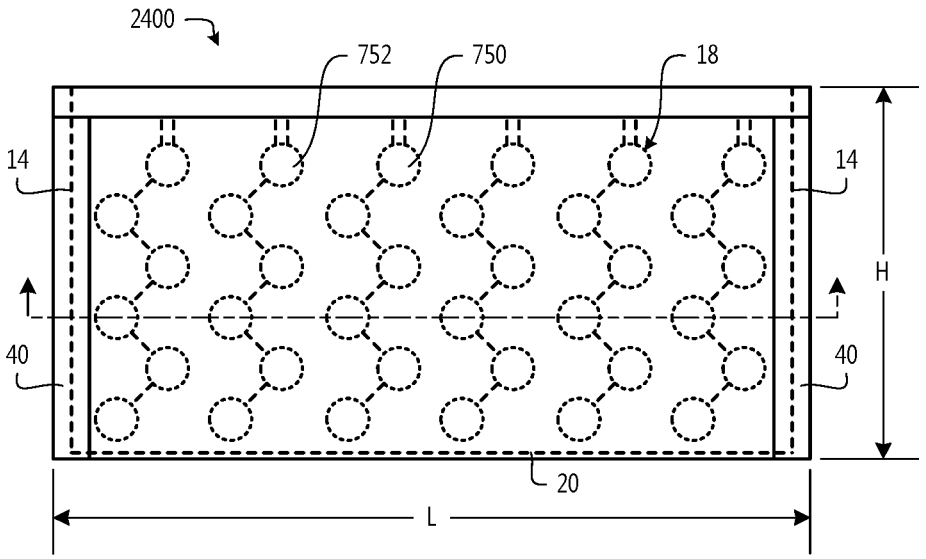
FIG. 24A is a front view of an exemplary embodiment of an inflatable pouch that includes the inflatable cushioning material of FIG. 23.
Figure 24B:
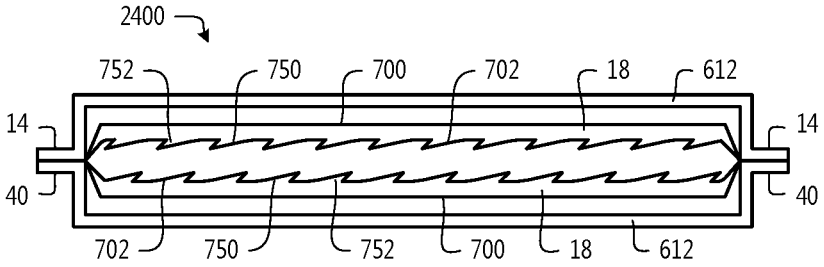
FIG. 24B is a cross-sectional view of the inflatable pouch of FIG. 24A in an uninflated state, shown along the line 24-24 of FIG. 24A.
Figure 24C:
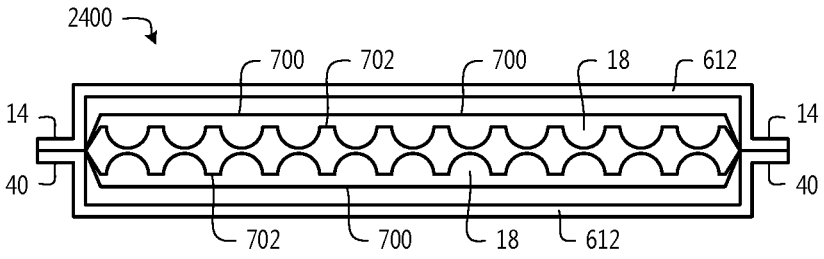
FIG. 24C is a cross-sectional view of the inflatable pouch of FIG. 24A s in an inflated state, shown along the line 24-24 of FIG. 24A.

FIGS. 24A-24C show an exemplary embodiment of an inflatable pouch 2400 made from the web 704 shown in FIGS. 22 and 23. The inflatable pouch 2400 includes at least one inflatable panel 18 (shown in dashed lines in FIG. 24A) and an outer skin 612. The inflatable pouch 2400 is formed by sealing a pair of panels 18 together along a bottom edge 20 and side edges 14, or by folding a larger panel in half along the bottom edge 20 and sealing the side edges 14 together. At least one of the panels 18 has an inflation pattern 750 that includes interconnected individual cells 752 arranged in an inflatable pattern. In the illustrated embodiment, the inflatable pouch includes one panel 18 that is folded at the bottom edge 20, and the outer skin 612 is sealed to the panel 18 at the side edges 14 by seals 40. This structure may be the case when the outer skin 612 is disposed completely around the pouch 2400 as shown, when the skin is connected to one side of the pouch, but not to the other, or when separate skins are attached to opposite sides of the pouch. By attaching the outer skin 612 to the pouch along the side edges 14, the skin will wrinkle less when the pouches are inflated, as compared to a skin that is attached to the entire surface(s) of the web pouch. The outer skin 612 attached in this manner will not wrinkle significantly, if the web is made from a vacuum process as disclosed in U.S. Pat. No. 6,423,166. In the illustrated embodiment, the outer skin 612 is attached to the panels 18 along an entire height H of the side edges 14 of the panels 18 by seals 40. In other embodiments, the outer skin 612 is attached to the panels 18 along only a portion of the height H of the side edges 14. In some embodiments, the outer skin 612 is attached, adhered, or bonded to an entire surface or substantially all of the surfaces of the panels.

Referring to FIGS. 24B and 24C, the one or more inflatable panels 18 have a first layer 700 and a second layer 702, in which the first layer 700 is substantially flat, and the second layer 702 includes the inflation pattern 750 of interconnected cells 752. The inflatable pouches 2400 may be stored in bulk amounts in a container in an uninflated state until an end-user is ready to use the material. Referring to FIG. 24B, when the inflatable pouch 2400 is in the uninflated state, the individual cells 752 of the inflation pattern 750 are substantially flat. In certain embodiments, after the inflatable panels 18 are made (as shown in FIG. 22), the panels 18 are flattened (e.g., by a roller mechanism) to take the form shown in FIG. 24B. Referring to FIG. 24C, after the inflatable pouch is inflated, the individual cells 752 expand to create a cushioning material. The inflatable pouch 2400 can be inflated by any suitable means. For example, one or both of the panels 18 can include an inflation channel (e.g., any inflation channel described in the present application). In one embodiment, only one inflation channel is included and the two panels of the pouch are in fluid communication, such that inflation of one of the panels inflates the other panel. The inflation channel may be as described by any one or more of U.S. Pat. Nos. 6,423,166; 8,357,439 and/or 8,038,348, each of which are incorporated herein by reference in their entirety.

The inflatable pouch 2400 is advantageous because the panels 18 have minimal shrinkage along the height H and length L of the pouch. That is, because the panels 18 include a flat side or layer 700 and a patterned side with an inflation pattern 750 of cells 752 that are flattened, the panels do not shrink or shrink significantly along the height H or length L of the panels. In one exemplary embodiment, inflation of the panels causes the cells 752 to take their original, non-flattened form (rather than causing the panels to shrink) and the flat panel 700 simply retains its original size. Because the panels 18 have minimal shrinkage, the outer skin 612 and the panels 18 both maintain their pre-inflation height H and length L, which means the outer skin 612 and the inflated panel 18 has a close-fitting configuration to prevent the outer skin 612 from becoming wrinkled due to inflation of the inflatable pouch 2400.

Figure 25C:
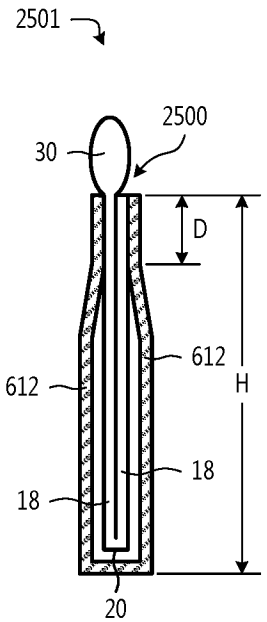
FIG. 25C is a sectional view of the inflatable packaging web of FIG. 25A, shown along the line 25C-25C of FIG. 25A.
Figure 25B:
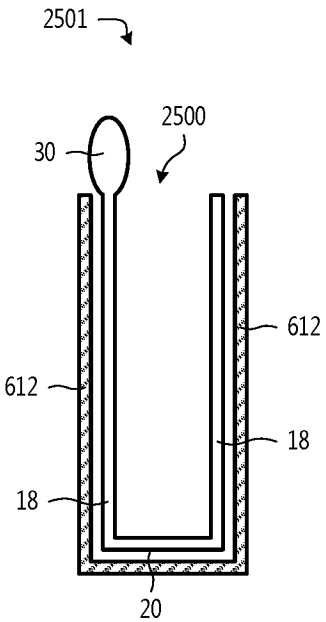
FIG. 25B is a sectional view of the inflatable packaging web of FIG. 25A, shown along the line 25B-25B of FIG. 25A.
Figure 25A:
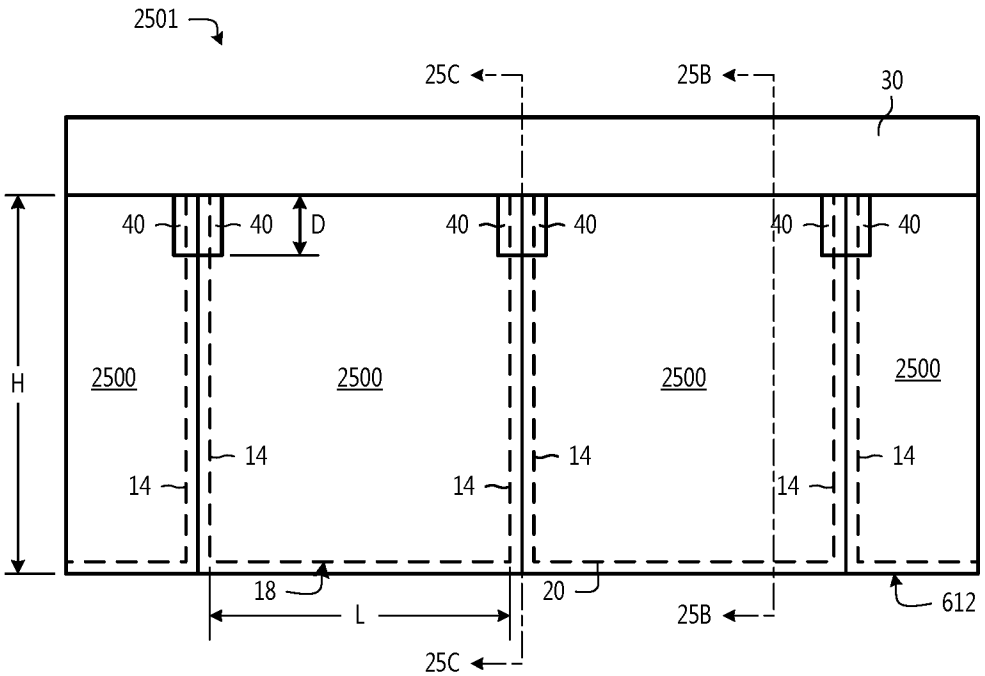
FIG. 25A is a front view of another exemplary embodiment of an inflatable packaging web.

FIGS. 25A-25C show an exemplary embodiment of an inflatable packaging web 2501 that includes a plurality of inflatable pouches 2500. Each inflatable pouch 2500 includes at least one inflatable panel 18 (shown in dashed lines in FIG. 25A) and an outer skin 612. The inflatable pouch 12 is formed by sealing a pair of panels 18 together along a bottom edge 20 and side edges 14, or by folding a larger panel in half along the bottom edge 20 and sealing the side edges 14 together. At least one of the panels 18 has an inflation pattern (e.g., any inflation pattern, such as any inflation pattern disclosed in the present application). In the illustrated embodiment, the inflatable pouch includes one panel 18 that is folded at the bottom edge 20, and the outer skin 612 is sealed to the panel(s) 18 along a portion of the height H of the side edges 14 of the panel 18 by seals 40. For example, the outer skin 612 can be attached to the panel(s) along less than 75% of the height H of the side edges 14, such as less than 50%, such as less than 40%, such as less than 25%, such as less than 20%, such as less than 15%, such as less than 10%, such as less than 5%, such as less than 1%. In some embodiments, the seal 40 between the outer skin and the panel 18 has a height D, and the ratio of the height H to the height D is between about 1/2 and about 1/32, such as about 1/4 and about 1/16, such as about 1/8.

One or both of the panels 18 include an inflation channel 30. In the illustrated embodiment, only one inflation channel 30 is included and the two panels of the pouch are in fluid communication, such that inflation of one of the panels inflates the other panel. The inflation channel 30 may be as described by any one or more of U.S. Pat. Nos. 6,423,166; 8,357,439; D646,972, 8,038,348, each of which are incorporated herein by reference in their entirety.

Figure 26B:
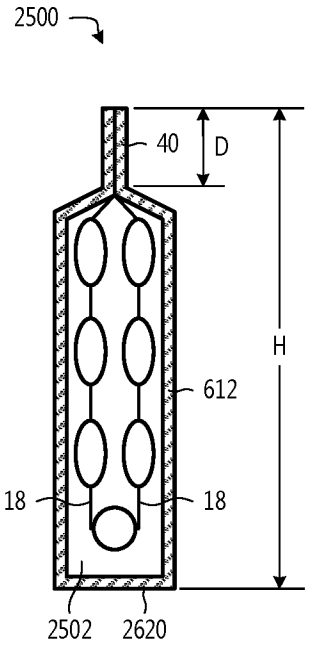
FIG. 26B is an exemplary embodiment of the inflatable pouch of FIG. 26A in an inflated state, shown along the line 26B-26B of FIG. 26A.
Figure 26A:
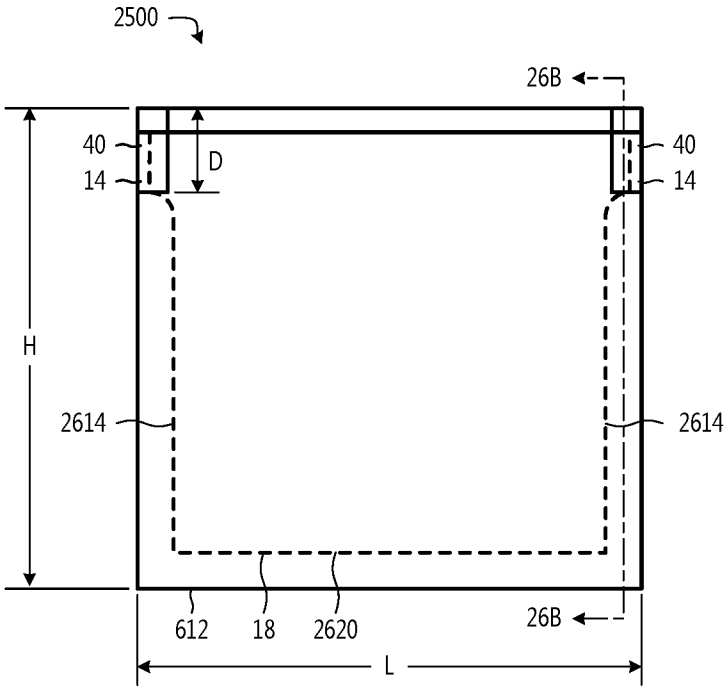
FIG. 26A is an exemplary embodiment of an inflatable pouch from the inflatable packaging web of FIG. 25A.

FIGS. 26A-26B illustrate an exemplary embodiment of an inflatable pouch 2500 made from the web 2501 of FIGS. 25A-25C, in which the inflatable pouch 2500 is in an inflated state. That is, FIG. 25A shows each inflatable pouch 2500 in an uninflated state (in which the panel(s) 18 are substantially the same size as the outer skin 612), and FIG. 26A shows an inflatable pouch in an inflated state (in which the panels 18 shrink along the height H and/or the length L of the inflatable pouch). Referring to FIGS. 26A and 26B, the outer skin 612 extends beyond the side edges 2614 and the bottom edge 2620 of the inflated panels 18. The outer skin 612 is capable of extending beyond the edges 2614, 2620 of the panel 18 because the outer skin 612 is attached to the inflatable panels only along a portion of the side edges 14 of the pouch 2500. Accordingly, the portions of the outer skin 612 that are not attached to the inflatable panels at the side edges 14 are not caused to move inward as the panels 18 shrink along the height H and/or length L of the pouch 2500. Because the edges of the outer skin 612 are not caused to move inward, the outer skin maintains a substantially smooth surface over the inflatable panel(s) 18, rather than becoming wrinkled. In one exemplary embodiment, the length L of the outer skin remains constant or substantially constant while the length of the panels 18 reduces by at least 5%, such as at least 10%, such as at least 15%, such as at least 20%, such as at least 25%, such as at least 30% when the panels are inflated. In one exemplary embodiment, the length H of the outer skin remains constant or substantially constant while the height of the panels 18 reduces by at least 2.5%, such as at least 5%, such as at least 7.5%, such as at least 10%, such as at least 12.5%, such as at least 15% when the panels are inflated. In some embodiments, the reduction of the height of the panel(s) due to inflation is less than the reduction of the length of the panel(s) due to inflation. For example, a ratio of the reduction in the height of the panel(s) due to inflation to the reduction of the length of the panels due to inflation is between about 3/4 and about 1/16, such as about 1/2 and about 1/8, such as about 1/4.

In one exemplary embodiment, the reduction in length and/or height of the panels 18 without a corresponding reduction in size of the outer skin 612 creates a sealed, air-filled chamber 2502 between the panels 18 and the outer skin 612. That is, the seal across the outer skins 612 or the outer skins 612 and panels 18 seals the air that is in the space between the outside surface of the panels and the inside surface of the outer skins. This sealed, air-filled chamber 2502 can provides additional cushioning for the product that is packaged inside the panels and can prevent or reduce wrinkling of the outer skins 612. The wrinkling can be prevented by air in the chamber 2502 that holds the outer skins in a taught or blown-up condition. In one exemplary embodiment, air is blown into the air-filled chamber 2502 before sealing of the outer skins. In another exemplary embodiment, air is not blown into the chamber, but is captured during the opening, product loading, and sealing operations of the packaging operation.

FIGS. 27A-27D show an exemplary embodiment of an inflatable pouch 2700 from a web (not shown) of inflatable pouches. The web can take any suitable form, such as, for example, any form described in the present application. The inflatable pouch 2700 includes at least one inflatable panel 18 (shown in dashed lines in FIGS. 27A and 27B) and an outer skin 612. In the illustrated embodiment, the inflatable pouch 2700 is formed by folding a single inflatable panel 18 in half along the bottom edge 20 and sealing the side edges 14 together. In other embodiments, a pair of panels 18 can be sealed together along the bottom edge 20 and the side edges 14. The panel 18 has an inflation pattern 2750 that includes various interconnected rows 2752 that extend along a length L of the pouch 2700. In the illustrated embodiment, the outer skin 612 is sealed to the panel 18 along a portion of the height H of the side edges 14 of the panel 18 by seals 40. For example, the outer skin 612 can be attached to the panel(s) along less than 75% of the height H of the side edges 14, such as less than 50%, such as less than 40%, such as less than 25%, such as less than 20%, such as less than 15%, such as less than 10%, such as less than 5%, such as less than 1%. In some embodiments, the seal 40 between the outer skin and the panel 18 has a height D, and the ratio of the height H to the height D is between about 1/2 and about 1/32, such as about 1/4 and about 1/16, such as about 1/8. In other embodiments, the outer skin 612 is attached to the panel 18 along an entire height H of the side edges 14 of the panel 18.

The pouch 2700 includes an inflation channel 30. In the illustrated embodiment, only one inflation channel 30 is included and the panel 18 is folded in half such that each side of the folded panel is in fluid communication with the inflation channel 30. In other embodiments, the pouch 2700 can include two inflation channels 30. The inflation channel 30 may be as described by any one or more of U.S. Pat. Nos. 6,423,166; 8,357,439; D646,972, 8,038,348, each of which are incorporated herein by reference in their entirety. Air is provided into the inflation channel 30 such that air moves through the openings 2751 of the inflation pattern 2750 to inflate the interconnected rows 2752.

Figure 27B:
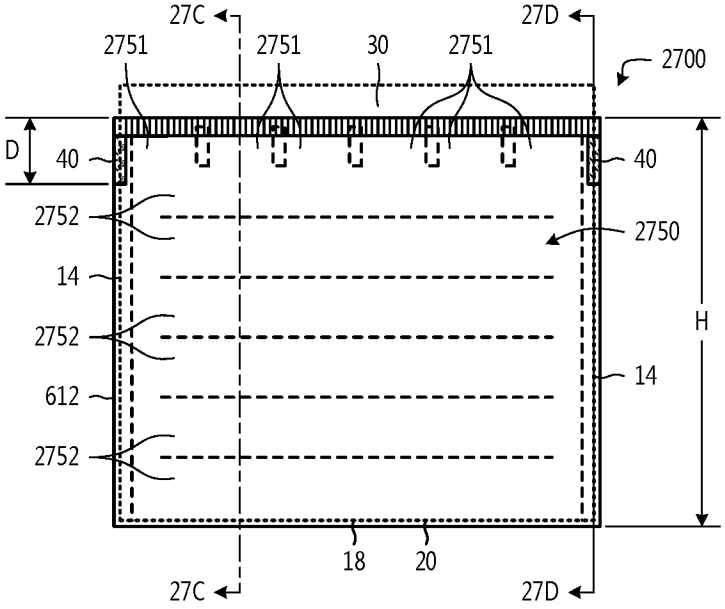
FIG. 27B is a rear view of the inflatable pouch of FIG. 27A in the uninflated state.
Figure 27A:
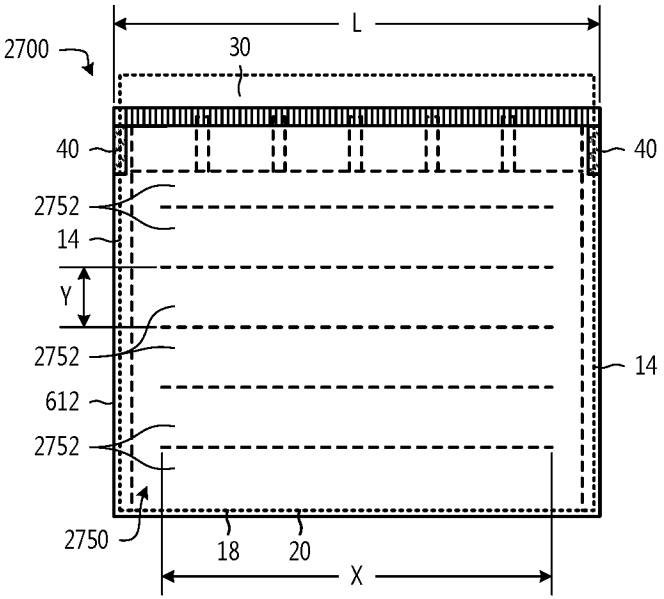
FIG. 27A is a front view of another exemplary embodiment of an inflatable pouch in an uninflated state.
Figure 27D:
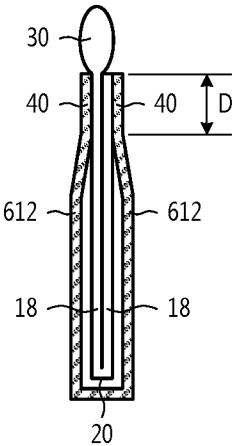
FIG. 27D is a cross-sectional view of the inflatable pouch of FIG. 27A in the uninflated state, shown along the line 27D-27D of FIG. 27A.
Figure 27C:
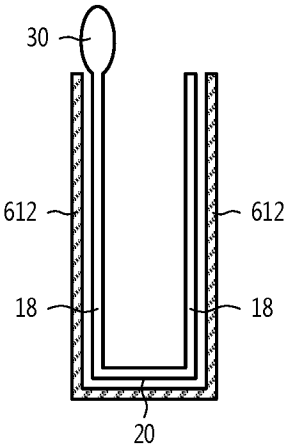
FIG. 27C is a cross-sectional view of the inflatable pouch of FIG. 27A in the uninflated state, shown along the line 27C-27C of FIG. 27B.
Figure 28C:
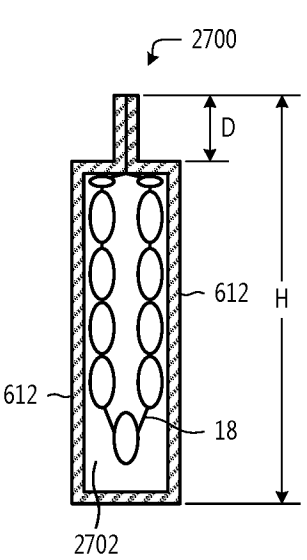
FIG. 28C is a cross-sectional view of the inflatable pouch of FIG. 27A in an inflated state, shown along the line 28C-28C of FIG. 28B.
Figure 28B:
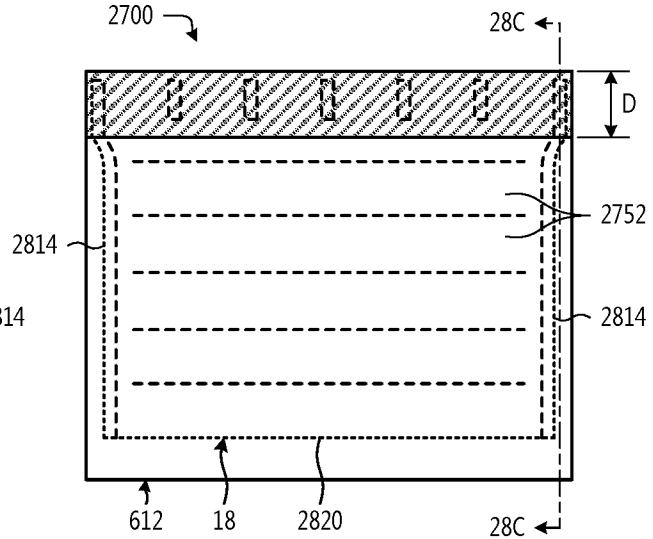
FIG. 28B is a rear view of the inflatable pouch of FIG. 27A in an inflated state.
Figure 28A:
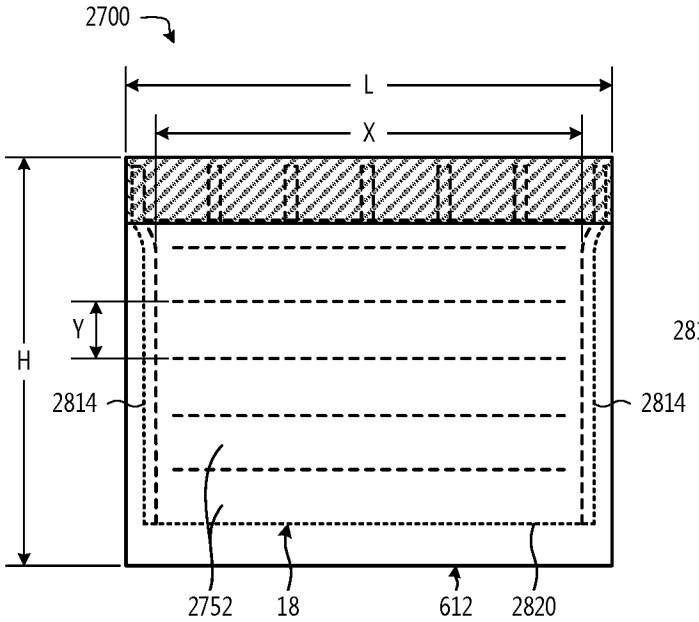
FIG. 28A is a front view of the inflatable pouch of FIG. 27A in an inflated state.

FIGS. 28A-28C illustrate the inflatable pouch 2700 of FIGS. 27A-27D in an inflated state. That is, FIGS. 27A-27D show the inflatable pouch 2700 in an uninflated state (in which the panel 18 is substantially the same size as the outer skin 612), and FIGS. 28A-28C show an inflatable pouch in an inflated state (in which the panels 18 shrink along the height H and/or the length L of the inflatable pouch). Referring to FIG. 27A, the length X of the inflation rows 2752 is greater than the height Y of the inflation rows 2752. Referring again to FIGS. 28A-28C, because the length X is greater than the height Y, inflation of the panel 18 causes the panel to shrink more along the height H of the pouch 2700 during inflation relative to the shrinkage of the panel 18 along the length L of the pouch 2700. In certain embodiments, the ratio of the length X to the height Y of the inflation rows 2752 is between about is between about 32/1 and about 4/1, such as about 16/1 and about 8/1, such as about 12/1.

After inflation, the outer skin 612 extends beyond the side edges 2814 and the bottom edge 2820 of the inflated panels 18. The outer skin 612 is capable of extending beyond the edges 2814, 2820 of the panel 18 because the outer skin 612 is only attached to the inflatable panels along a portion of the side edges 14 of the pouch 2500. Accordingly, the portions of the outer skin 612 that are not attached to the inflatable panels at the side edges 14 are not caused to move inward as the panels 18 shrink along the height H and/or length L of the pouch 2700. Because the edges of the outer skin 612 are not caused to move inward, the outer skin maintains a substantially smooth surface over the inflatable panel(s) 18, rather than becoming wrinkled. In other embodiments, the outer skin 612 can be sealed to the panel 18 along substantially the entire height H of the pouch 2700. In these embodiments, because the shrinkage of the panel 18 along the length L is minimal (as the majority of the shrinkage occurs along the height H), the outer skin 612 is prevented from wrinkling over the panel 18 or the wrinkling is reduced or minimized. This reduction in wrinkling is because the side edges 2814 of the panel 18 do not cause the side edges of the outer skin 612 to substantially move along the length L of the pouch 2700, and the bottom edge of the outer skin 612 is not sealed to the bottom edge 2820 of the panel 18, which prevents the outer skin 612 from moving inward along the height H of the pouch 2700.

In one exemplary embodiment, the height H of the outer skin remains constant or substantially constant while the height of the panels 18 reduces by at least 5%, such as at least 10%, such as at least 15%, such as at least 20%, such as at least 25%, such as at least 30% when the panels are inflated. In one exemplary embodiment, the length L of the outer skin remains constant or substantially constant while the length L of the panels 18 reduces by at least 2.5%, such as at least 5%, such as at least 7.5%, such as at least 10%, such as at least 12.5%, such as at least 15% when the panels are inflated. In some embodiments, the reduction of the length of the panel(s) due to inflation is less than the reduction of the height of the panel(s) due to inflation. For example, a ratio of the reduction in the height of the panel(s) due to inflation to the reduction of the length of the panels due to inflation is between about 4/3 and about 16/1, such as about 2/1 and about 8/1, such as about 4/1.

In one exemplary embodiment, the reduction in length and/or height of the panels 18 without a corresponding reduction in size of the outer skin 612 creates a sealed air-filled chamber 2702 between the panels 18 and the outer skin 612. That is, the seal across the outer skins 612 or the outer skins 612 and panels 18 seals the air that is in the space between the outside surface of the panels and the inside surface of the outer skins. This sealed, air-filled chamber 2702 can provide additional cushioning for the product that is packaged inside the panels and can prevent or reduce wrinkling of the outer skins 612. The wrinkling can be prevented by air in the chamber 2702 that holds the outer skins in a taught or blown-up condition. In one exemplary embodiment, air is blown into the air-filled chamber 2702 before sealing of the outer skins. In another exemplary embodiment, air is not blown into the chamber, but is captured during the opening, product loading, and sealing operations of the packaging operation.

FIGS. 29A-29D show an exemplary embodiment of an inflatable pouch 2900 made from a web (not shown) of inflatable pouches. The web can take any suitable form, such as, for example, any form described in the present application. The inflatable pouch 2900 includes at least one inflatable panel 18 (shown in dashed lines in FIGS. 29A and 29B) and an outer skin 612. In the illustrated embodiment, the inflatable pouch 2900 is formed by folding a single inflatable panel 18 in half along the bottom edge 20 and sealing the side edges 14 together. In other embodiments, a pair of panels 18 can be sealed together along the bottom edge 20 and the side edges 14. The panel 18 has an inflation pattern 2950 that includes various interconnected rows 2952 that extend along a length L of the pouch 2900. In the illustrated embodiment, the outer skin 612 is sealed to the panel 18 along a portion of the height H of the side edges 14 of the panel 18 by seals 40. For example, the outer skin 612 can be attached to the panel(s) along less than 75% of the height H of the side edges 14, such as less than 50%, such as less than 40%, such as less than 25%, such as less than 20%, such as less than 15%, such as less than 10%, such as less than 5%, such as less than 1%. In some embodiments, the seal 40 between the outer skin and the panel 18 has a height D, and the ratio of the height H to the height D is between about 1/2 and about 1/32, such as about 1/4 and about 1/16, such as about 1/8. In other embodiments, the outer skin 612 is attached to the panel 18 along an entire height H of the side edges 14 of the panel 18.

The pouch 2900 includes an inflation channel 30. In the illustrated embodiment, only one inflation channel 30 is included and the panel 18 is folded in half such that each side of the folded panel is in fluid communication with the inflation channel 30. In other embodiments, the pouch 2900 can include two inflation channels 30. The inflation channel 30 may be as described by any one or more of U.S. Pat. Nos. 6,423,166; 8,357,439; and 8,038,348, each of which are incorporated herein by reference in their entirety. Air is provided into the inflation channel 30 such that air moves through the openings 2951*a*, 2951*b* of the inflation pattern 2950 to inflate the interconnected rows 2952. In the illustrated embodiment, one or more rows 2952 are configured to receive air through openings 2951*a*, and other rows 2952 are configured to receive air through openings 2951*b*. The rows 2952 can, however, be in fluid communication with the inflation channel 30 by any suitable number of openings 2951*a*, 2951*b*.

Figure 29B:
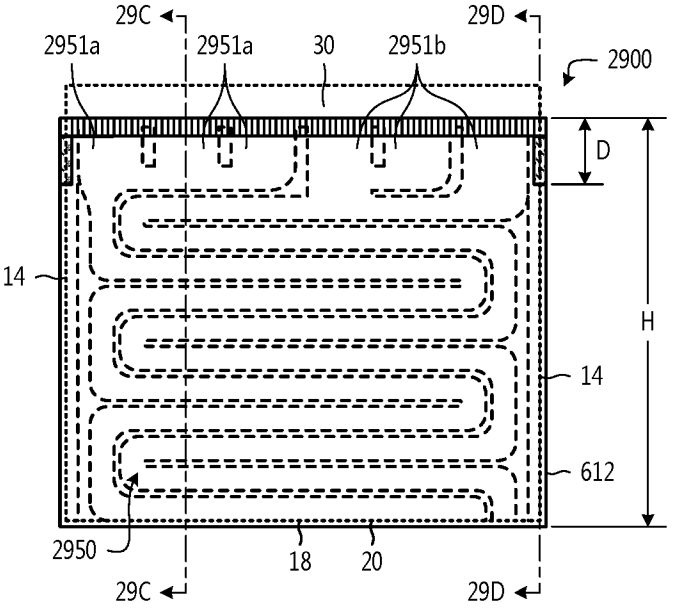
FIG. 29B is a rear view of the inflatable pouch of FIG. 29A in the uninflated state.
Figure 29A:
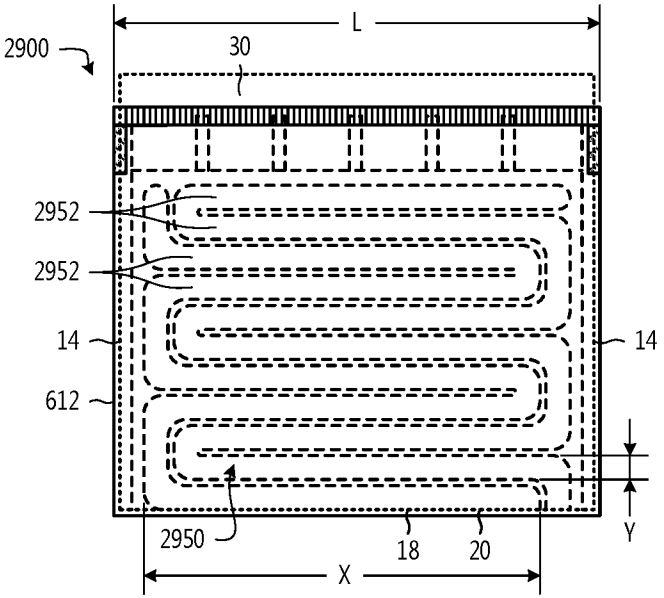
FIG. 29A is a front view of another exemplary embodiment of an inflatable pouch in an uninflated state.
Figure 29D:
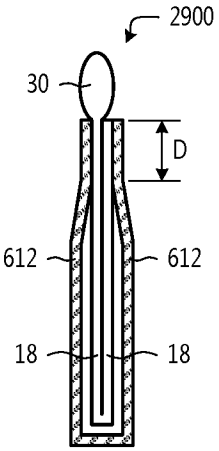
FIG. 29D is a cross-sectional view of the inflatable pouch of FIG. 29A in the uninflated state, shown along the line 29D-29D of FIG. 29A.
Figure 29C:
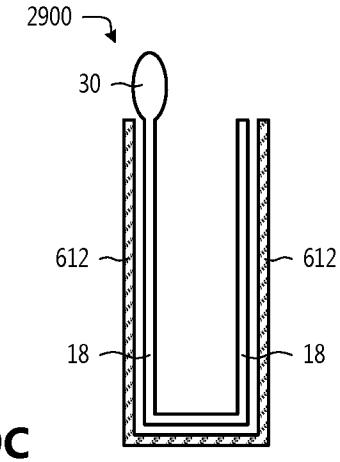
FIG. 29C is a cross-sectional view of the inflatable pouch of FIG. 29A in the uninflated state, shown along the line 29C-29C of FIG. 29B.
Figure 30C:
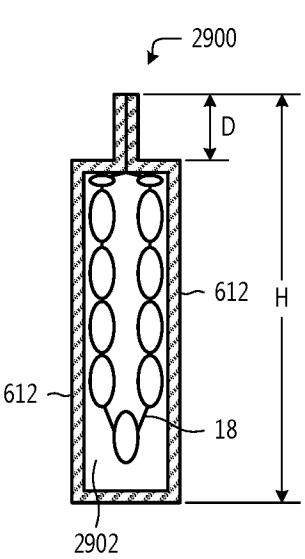
FIG. 30C is a cross-sectional view of the inflatable pouch of FIG. 29A in an inflated state, shown along the line 30C-30C of FIG. 30B.
Figure 30B:
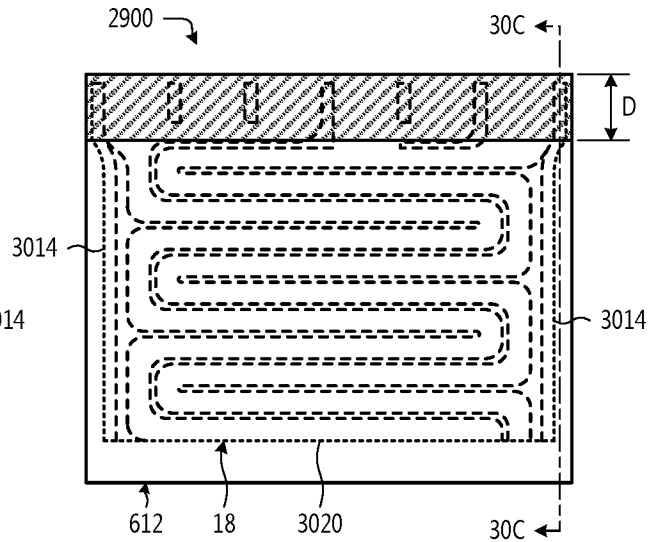
FIG. 30B is a rear view of the inflatable pouch of FIG. 29A in an inflated state.
Figure 30A:
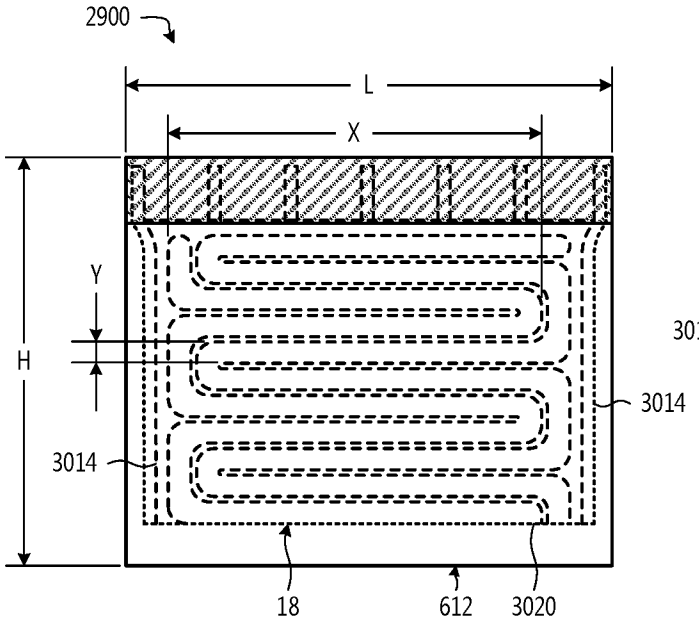
FIG. 30A is a front view of the inflatable pouch of FIG. 29A in an inflated state.

FIGS. 30A-30C illustrate the inflatable pouch 2900 of FIGS. 29A-29D in an inflated state. That is, FIGS. 29A-29D show the inflatable pouch 2900 in an uninflated state (in which the panel 18 is substantially the same size as the outer skin 612), and FIGS. 30A-30C show an inflatable pouch in an inflated state (in which the panels 18 shrink along the height H and/or the length L of the inflatable pouch). Referring to FIG. 29A, the length X of the inflation rows 2952 is greater than the height Y of the inflation rows 2952. Referring again to FIGS. 28A-28C, because the length X is greater than the height Y, inflation of the panel 18 causes the panel to shrink more along the height H of the pouch 2900 during inflation relative to the shrinkage of the panel 18 along the length L of the pouch 2900. In certain embodiments, the ratio of the length X to the height Y of the inflation rows 2752 is between about is between about 32/1 and about 4/1, such as about 16/1 and about 8/1, such as about 12/1.

After inflation, the outer skin 612 extends beyond the side edges 3014 and the bottom edge 3020 of the inflated panels 18. The outer skin 612 is capable of extending beyond the edges 3014, 3020 of the panel 18 because the outer skin 612 is only attached to the inflatable panels along a portion of the side edges 14 of the pouch 2900. Accordingly, the portions of the outer skin 612 that are not attached to the inflatable panels at the side edges 14 are not caused to move inward as the panels 18 shrink along the height H and/or length L of the pouch 2900. Because the edges of the outer skin 612 are not caused to move inward, the outer skin maintains a substantially smooth surface over the inflatable panel(s) 18, rather than becoming wrinkled. In other embodiments, the outer skin 612 can be sealed to the panel 18 along substantially the entire height H of the pouch 2900. In these embodiments, because the shrinkage of the panel 18 along the length L is minimal (as the majority of the shrinkage occurs along the height H), the outer skin 612 is prevented from wrinkling over the panel 18 because the side edges 3014 of the panel 18 do not cause the side edges of the outer skin 612 to substantially move along the length L of the pouch 2900, and the bottom edge of the outer skin 612 is not sealed to the bottom edge 3020 of the panel 18, which prevents the outer skin 612 from moving inward along the height H of the pouch 2900.

Still referring to FIGS. 30A-30C, in one exemplary embodiment, the height H of the outer skin remains constant or substantially constant while the height of the panels 18 reduces by at least 5%, such as at least 10%, such as at least 15%, such as at least 20%, such as at least 25%, such as at least 30% when the panels are inflated. In one exemplary embodiment, the length L of the outer skin remains constant or substantially constant while the length L of the panels 18 reduces by at least 2.5%, such as at least 5%, such as at least 7.5%, such as at least 10%, such as at least 12.5%, such as at least 15% when the panels are inflated. In some embodiments, the reduction of the length of the panel(s) due to inflation is less than the reduction of the height of the panel(s) due to inflation. For example, a ratio of the reduction in the height of the panel(s) due to inflation to the reduction of the length of the panels due to inflation is between about 4/3 and about 16/1, such as about 2/1 and about 8/1, such as about 4/1.

Still referring to FIGS. 30A-30C, in one exemplary embodiment the reduction in length and/or height of the panels 18 without a corresponding reduction in size of the outer skin 612 creates a sealed, air-filled chamber 2902 between the panels 18 and the outer skin 612. That is, the seal across the outer skins 612 or the outer skins 612 and panels 18 seals the air that is in the space between the outside surface of the panels and the inside surface of the outer skins. This sealed, air-filled chamber 2902 can provide additional cushioning for the product that is packaged inside the panels and can prevent or reduce wrinkling of the outer skins 612. The wrinkling can be prevented by air in the chamber 2902 that holds the outer skins in a taught or blown-up condition. In one exemplary embodiment, air is blown into the air-filled chamber 2902 before sealing of the outer skins. In another exemplary embodiment, air is not blown into the chamber, but is captured during the opening, product loading, and sealing operations of the packaging operation.

Figure 31A:
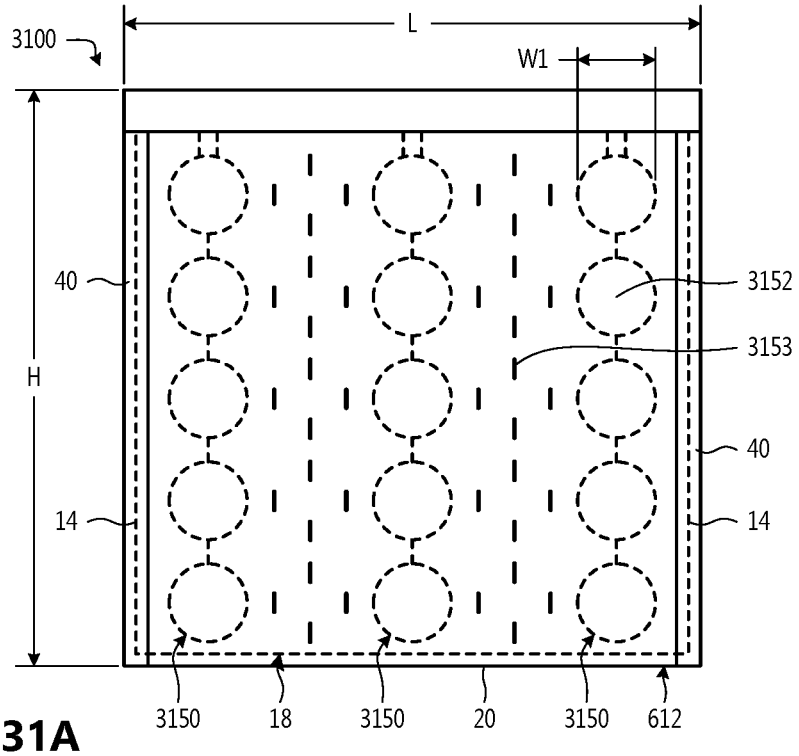
FIG. 31A is a front view of another exemplary embodiment of an inflatable pouch in an uninflated state.
Figure 31B:
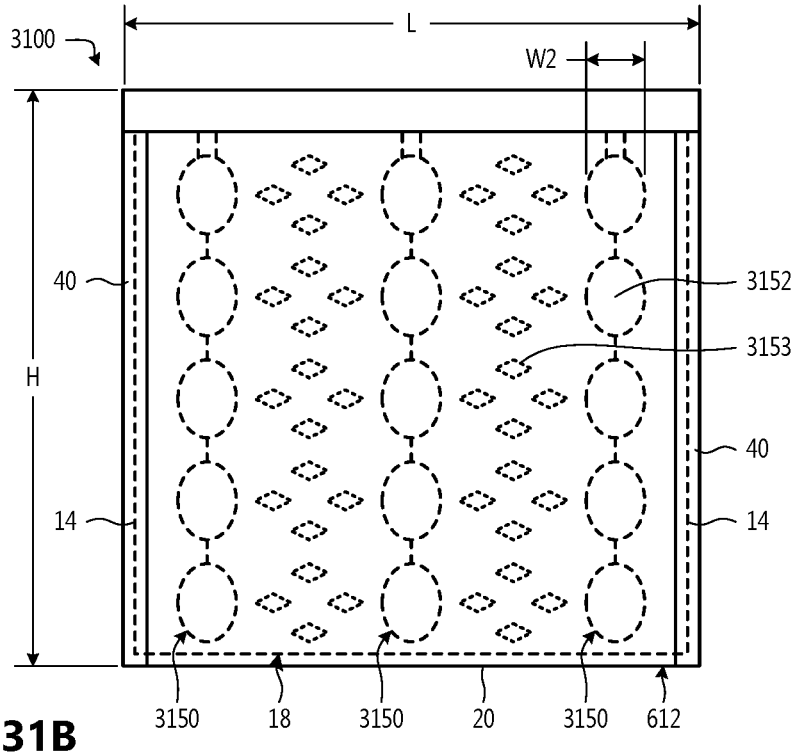
FIG. 31B is the inflatable pouch of FIG. 31A in the inflated state.

FIGS. 31A and 31B show an exemplary embodiment of an inflatable pouch 3100 from a web (not shown) of inflatable pouches. FIG. 31A shows the pouch 3100 in an uninflated state, and FIG. 31B shows the pouch 3100 in an inflated state. The web can take any suitable form, such as, for example, any form described in the present application. The inflatable pouch 3100 includes at least one inflatable panel 18 (shown in dashed lines) and an outer skin 612. The inflatable pouch 3100 is formed by sealing a pair of panels 18 together along a bottom edge 20 and side edges 14, or by folding a larger panel in half along the bottom edge 20 and sealing the side edges 14 together. At least one of the panels 18 has one or more inflation patterns 3150 that includes interconnected individual cells 3152 arranged in a series of patterns. In addition, the panel 18 has a plurality of cuts 3153 disposed between the inflation patterns 3152. The cuts allow the inflatable panel to stretch and expand to keep the length of the inflatable panel 18 the same as the fixed length of the outer skin 612. The cuts can take a wide variety of different forms. For example, the cuts 3153 can be made as shown in U.S. Patent Publication No. 2015/0209992, which is incorporated herein by reference in its entirety. In other exemplary embodiments, instead or in addition to having the cuts 3153, the material between the inflation patterns can be stretchable to allow the inflatable panel to stretch and expand to keep the length of the inflatable panel 18 the same as the fixed length of the outer skin 612.

In the illustrated embodiment, the inflatable pouch includes one panel 18 that is folded at the bottom edge 20, and the outer skin 612 is sealed to the panel 18 at the side edges 14 by seals 40. By attaching the outer skin 612 to the pouch along the side edges 14, the skin will wrinkle less when the pouches are inflated, as compared to a skin that is attached to the entire surface(s) of the web pouch. The outer skin 612 attached in this manner will not wrinkle significantly, if the web is made from a vacuum process as disclosed in U.S. Pat. No. 6,423,166. In the illustrated embodiment, the outer skin 612 is attached to the panels 18 along an entire height H of the side edges 14 of the panels 18 by seals 40. In other embodiments, the outer skin 612 is attached to the panels 18 along only a portion of the height H of the side edges 14. In some embodiments, the outer skin 612 is attached, adhered, or bonded to an entire surface or substantially all of the surface of the panels.

The inflatable pouch 3100 can be inflated by any suitable means. For example, one or both of the panels 18 can include an inflation channel (e.g., any inflation channel described in the present application). In one embodiment, only one inflation channel is included and the two panels of the pouch are in fluid communication, such that inflation of one of the panels inflates the other panel. The inflation channel may be as described by any one or more of U.S. Pat. Nos. 6,423,166; 8,357,439; D646,972, 8,038,348, each of which are incorporated herein by reference in their entirety.

The inflatable pouch 3100 is advantageous because the panels 18 have minimal shrinkage along the height H and/or length L of the pouch during inflation. That is, referring to FIG. 31A, the interconnected cells 3152 have a width W1 in the uninflated state, and, referring to FIG. 31B, the cells have a width W2 in the inflated state, in which the width W1 is greater than the width W2. Referring to FIG. 31B, because inflation of the cells 3152 causes the width of the cells to shrink, and because the seal 40 between the outer skin 612 and the panels 18 are providing a tension force on the panels 18, inflation of the panels 18 causes the plurality of cuts 3153 to move from a closed position (as shown in FIG. 31A) to an open position (as shown in FIG. 31B). This movement of the plurality of cuts 3153 from the closed position to the open position prevents the panels 18 from shrinking along the length L of the pouch 3100. Because the panels 18 have minimal shrinkage, the outer skin 612 and the panels 18 can substantially maintain their pre-inflation height H and/or length L, which means the outer skin 612 and the inflated panel 18 has a close-fitting configuration in the height and/or length direction to prevent the outer skin 612 from becoming wrinkled.

FIGS. 32A-32E show an exemplary embodiment of an inflatable packaging web 3201 that includes a plurality of inflatable pouches 3200. Each inflatable pouch 3200 includes at least one inflatable panel 18 (shown in dashed lines in FIG. 32A) and an outer skin 612. The inflatable pouch 3200 is formed by sealing a pair of panels 18 together along a bottom edge 20 and side edges 14, or by folding a larger panel in half along the bottom edge 20 and sealing the side edges 14 together. At least one of the panels 18 has an inflation pattern (e.g., any inflation pattern, such as any inflation pattern disclosed in the present application). In the illustrated embodiment, the inflatable pouch includes one panel 18 that is folded at the bottom edge 20, and the outer skin 612 is sealed to the panel(s) 18 along the entire height H of the side edges 14 of the panel 18 by seals 40. In other embodiments, the outer skin 612 can be attached to the panel(s) along only a portion of the height H of the side edges 14, such as being attached along less than 75% of the height H, such as less than 50%, such as less than 40%, such as less than 25%, such as less than 20%, such as less than 15%, such as less than 10%, such as less than 5%, such as less than 1%. In some embodiments, the ratio of the height of the seals 40 to the height of the height H of side edges 14 is between about 1/2 and about 1/32, such as about 1/4 and about 1/16, such as about 1/8. In the illustrated exemplary embodiment, though, the ratio is 1/1, since the outer skin 612 is sealed to the panel(s) 18 along the entire height H of the side edges 14 of the panel 18 by seals 40.

One or both of the panels 18 include an inflation channel 30. In the illustrated embodiment, only one inflation channel 30 is included and the two panels of the pouch are in fluid communication, such that inflation of one of the panels inflates the other panel. The inflation channel 30 may be as described by any one or more of U.S. Pat. Nos. 6,423,166; 8,357,439; D646,972, 8,038,348, each of which are incorporated herein by reference in their entirety.

Referring to FIGS. 32A and 32D-32E, in some embodiments, the panels 18 of the inflatable pouch 3200 include one or more folded portions or pleats 3215. The pleats 3215 allow the panels 18 to be inflated without the length L of the panels 18 shrinking. That is, if the panels 18 did not have pleats 3215, the panels would shrink along their length L during inflation, which would cause the seals 40 to move inward and the outer skin 612 to become wrinkled over the panels 18. The one or more pleats 3215 allow for the panels 18 to have additional material such that inflation and shrinkage of the panels 18 causes the pleats to become straightened and the panels 18 to substantially maintain their original length L (as shown in FIGS. 33A and 33C). The panel(s) 18 can have, for example, one or more pleats, two or more pleats, three or more pleats, four or more pleats, five or more pleats, six or more pleats, etc. Referring to FIGS. 32D and 32E, the pleats 3215 can have a length L1 of between about 0.25 inches and about 10 inches, such as between about 0.5 inches and about 7 inches, such as between about 0.75 inches and about 6 inches, such as between about 1 inches and about 6 inches. However, any pleat size can be selected. For example, in one exemplary embodiment the size of the pleat is selected such that the length of the inflated pouches is from 75% to 125% of the length of the outer skins, such as from 80% to 120% of the length of the outer skins, such as from 85% to 115% of the length of the outer skins, such as from 90% to 110% of the length of the outer skins, such as from 95% to 105% of the length of the outer skins.

Figure 33B:
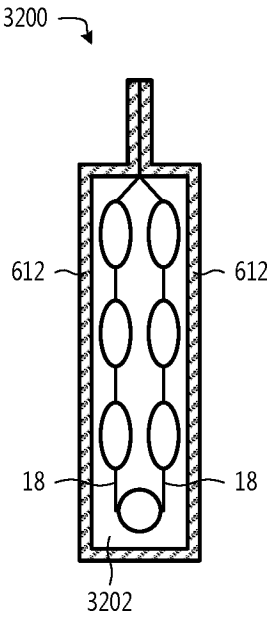
FIG. 33B is a sectional view of the inflatable pouch of FIG. 33A, shown along the line 33B-33B of FIG. 33A.
Figure 33A:
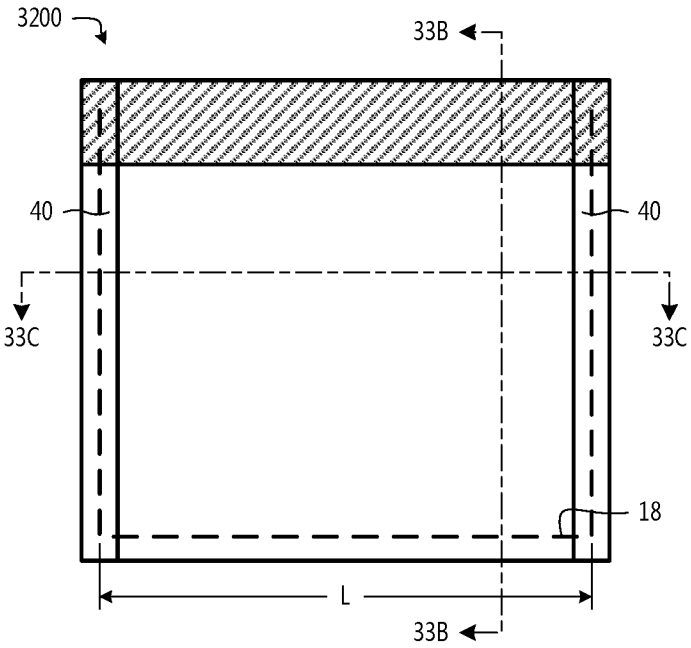
FIG. 33A is an exemplary embodiment of an inflatable pouch from the inflatable packaging web of FIG. 31A.
Figure 33C:
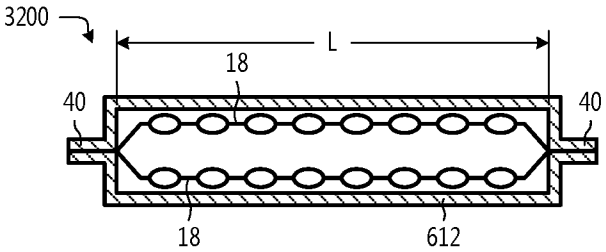
FIG. 33C is a sectional view of the inflatable pouch of FIG. 33A, shown along the line 33C-33C of FIG. 33A.

FIGS. 33A-33C illustrate an exemplary embodiment of an inflatable pouch 3200 made from the web 3201 of FIGS. 32A-32C, in which the inflatable pouch 3200 is in an inflated state. That is, FIG. 32A shows each inflatable pouch 3200 in an uninflated state (in which the panel(s) 18 include one or more folded portions or pleats 3215), and FIG. 33A shows an inflatable pouch in an inflated state (in which the panels 18 no longer include the folded portions or pleats 3215, but substantially maintain their original length L from the uninflated state, because the pleats or folds are unfolded by inflation). Because the length L of the unfolded panels 18 in the inflated state (as shown in FIGS. 33A and 33C) is substantially the same as the length L of the folded or pleated panels 18 in the uninflated state (as shown in FIGS. 32A and 32D-32E), the outer skin 612 maintains a substantially smooth surface over the inflatable panels 18, rather than becoming wrinkled.

In some embodiments, a sealed, air-filled chamber 3202 is formed between the panels 18 and the outer skin 612. That is, the seal across the outer skins 612 or the outer skins 612 and panels 18 seals the air that is in the space between the outside surface of the panels and the inside surface of the outer skins. This sealed, air-filled chamber 3202 can provide additional cushioning for the product that is packaged inside the panels and can prevent or reduce wrinkling of the outer skins 612. The wrinkling can be prevented by air in the chamber 3202 that holds the outer skins in a taught or blown-up condition. In one exemplary embodiment, air is blown into the air-filled chamber 3202 before sealing of the outer skins. In another exemplary embodiment, air is not blown into the chamber, but is captured during the opening, product loading, and sealing operations of the packaging operation.

FIGS. 34A-34F show an exemplary embodiment of an inflatable packaging web 3401 that includes a plurality of inflatable pouches 3400. Each inflatable pouch 3400 includes at least one inflatable panel 18 (shown in dashed lines in FIG. 34A) and an outer skin 612. The inflatable pouch 3400 is formed by sealing a pair of panels 18 together along a bottom edge 20 and side edges 14, or by folding a larger panel in half along the bottom edge 20 and sealing the side edges 14 together. The panels 18 can have an inflation pattern (e.g., any inflation pattern, such as any inflation pattern disclosed in the present application).

In the illustrated embodiment, the inflatable pouch includes one panel 18 that is folded at the bottom edge 20, and the outer skin 612 is sealed to the panel(s) 18 along a portion of the height H of the side edges 14 of the panel 18 by seals 40. For example, the outer skin 612 can be attached to the panel(s) along less than 75% of the height H of the side edges 14, such as less than 50%, such as less than 40%, such as less than 25%, such as less than 20%, such as less than 15%, such as less than 10%, such as less than 5%, such as less than 1%. In some embodiments, the seal 40 between the outer skin and the panel 18 has a height D, and the ratio of the height H to the height D is between about 1/2 and about 1/32, such as about 1/4 and about 1/16, such as about 1/8 or such as about 1/16. In other embodiments, the outer skin 612 is attached to the panel 18 along an entire height H of the side edges 14 of the panel 18.

One or both of the panels 18 include an inflation channel 30. In the illustrated embodiment, only one inflation channel 30 is included and the two panels of the pouch are in fluid communication, such that inflation of one of the panels inflates the other panel. The inflation channel 30 may be as described by any one or more of U.S. Pat. Nos. 6,423,166; 8,357,439; D646,972, 8,038,348, each of which are incorporated herein by reference in their entirety.

In the illustrated embodiment, the panels 18 of the inflatable pouch 3400 are folded (at fold line 3407) such that the panels 18 have a first portion 3404 and a folded portion 3406 that is folded over the first portion 3404. The outer skin 612 has a height H, the first portion 3404 of the panels 18 has a height H1 in an uninflated state, and the folded portion 3406 of the panels 18 has a height H2 in an uninflated state. In one exemplary embodiment, in the uninflated state shown in FIG. 34B, the height H1 plus the height H2 is greater than the height H of the outer skin. Inflation of the panels 18 causes the panels 18 to move from a folded position to an unfolded position. Inflation of the panels 18 also causes the height of the panels to shrink as the panels move from the uninflated state to the inflated state. The unfolded height of the panels 18 in an uninflated state is substantially equal to the height H1 of the first portion 3404 plus the height H2 of the folded portion. While the illustrated embodiment shows the panels 18 having a single fold (at fold line 3407) between a top edge 19 and a bottom edge 20 of the panels 18, it should be understood that the panels 18 can have any suitable number of folds between the top and bottom edges, such as, for example, two folds, three folds, four folds, etc. In any of these embodiments, the number of portions (e.g., first portion 3404 and second portion 3406) of the panels 18 depends on the number of fold lines, and the unfolded height of the panels 18 in the uninflated state is substantially equal to the sum of the heights of each portion. In certain embodiments, unfolded height of the panels 18 in an uninflated state is greater than or equal to the height H of the outer skin 612, or, in another embodiment, the panels 18 or a portion of the panels can be rolled up to achieve the same effect. In one exemplary embodiment, in the uninflated state shown in FIG. 34B, the height H1 plus the height H2 is greater than the height H of the outer skin.

Figure 34C:
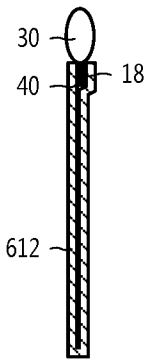
FIG. 34C is a sectional view of the inflatable packaging web of FIG. 34A, shown along the line 34C-34C of FIG. 34A.
Figure 34B:
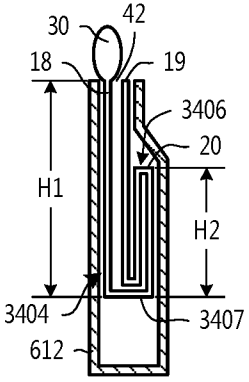
FIG. 34B is a sectional view of the inflatable packaging web of FIG. 34A, shown along the line 34B-34B of FIG. 34A.
Figure 34A:
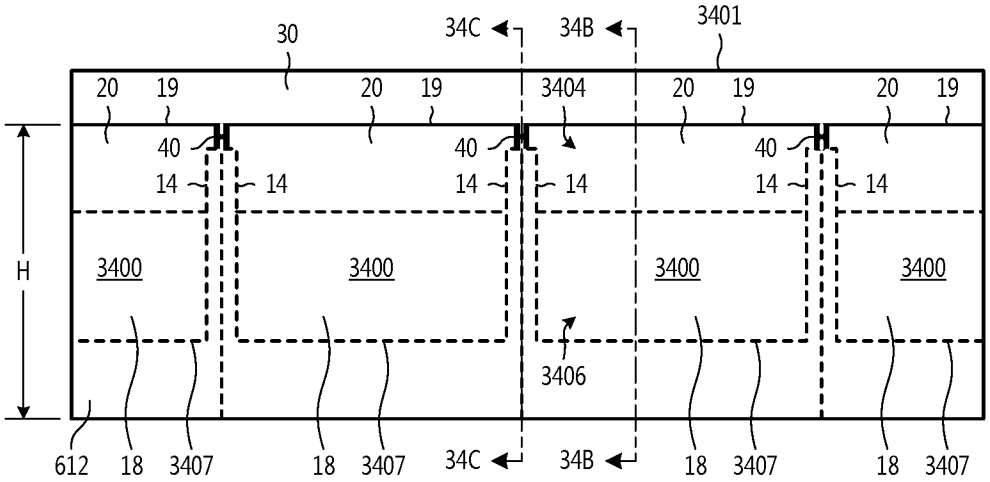
FIG. 34A is a front view of another exemplary embodiment of an inflatable packaging web.
Figure 34D:
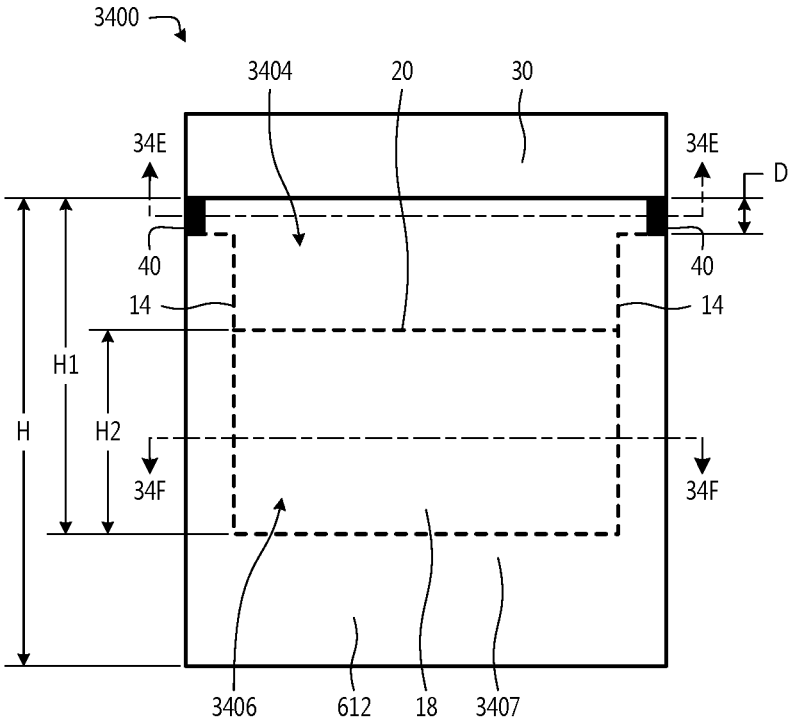
FIG. 34D is a front view of an inflatable pouch from the inflatable packaging web of FIG. 34A, shown in an uninflated state.
Figure 34E:
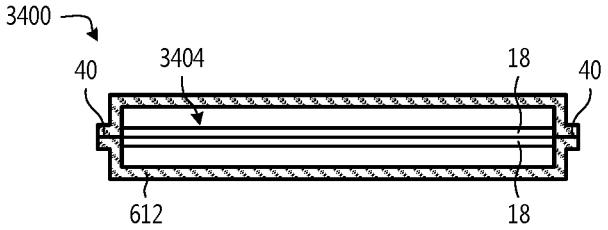
FIG. 34E is a sectional view of the inflatable pouch of FIG. 34D, shown along the line 34E-34E of FIG. 34D.
Figure 34F:
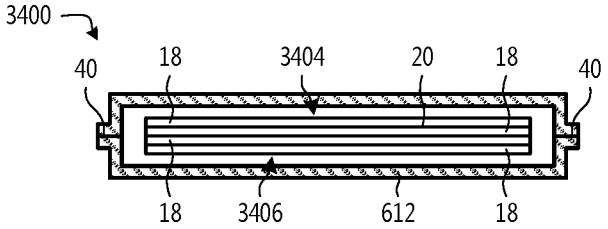
FIG. 34F is a sectional view of the inflatable pouch of FIG. 34D, shown along the line 34F-34F of FIG. 34D.
Figure 35B:
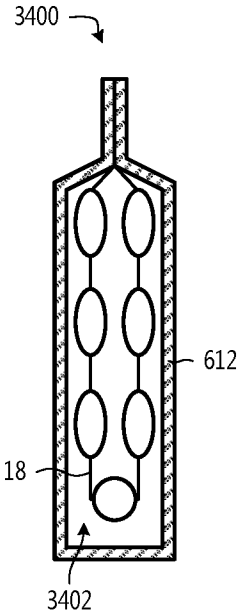
FIG. 35B is a sectional view of the inflatable pouch of FIG. 35A, shown along the line 35B-35B of FIG. 35A.
Figure 35A:
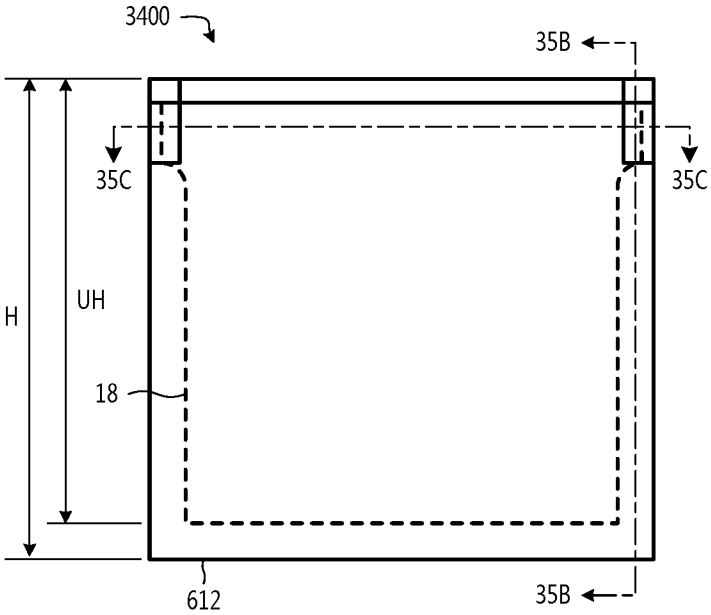
FIG. 35A is a front view of the inflatable pouch of FIG. 34D, shown in an inflated state.
Figure 35C:
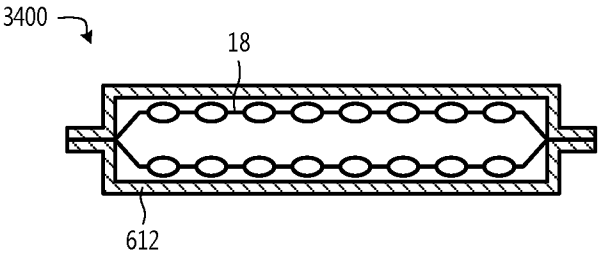
FIG. 35C is a sectional view of the inflatable pouch of FIG. 35A, shown along the line 35C-35C of FIG. 35A.

FIGS. 34D-34F illustrate an exemplary embodiment of an inflatable pouch 3400 from the web 3401 of FIGS. 34A-34F, in which the panels 18 are in an uninflated state. FIGS. 35A-35C illustrate an exemplary embodiment of an inflatable pouch 3400 from the web 3401 of FIGS. 34A-34F, in which the panels 18 are in an inflated state. Referring to FIG. 35A, the unfolded height UH of the panels 18 in the inflated state is less than or equal to the height H of the outer skin 612. In other embodiments, the unfolded height UH of the panels 18 can be greater than the height H of the outer skin 612. Because the height UH of the unfolded panels 18 in the inflated state (as shown in FIGS. 35A-35C) is substantially the same as the height H of the outer skin 612, the outer skin 612 maintains a substantially smooth surface over the inflatable panels 18, rather than becoming wrinkled. In addition, folding the panels 18 prior to inflation allows for the unfolded height UH of the inflated panels to be larger than embodiments in which the panels 18 are not folded prior to inflation. That is, because the height of the panels 18 shrink during inflation, having panels 18 that have a larger unfolded height (in the uninflated state) than the height H of the outer skin 612 allows the panels 18 to shrink to a height that is substantially equal to the height H of the outer skin after inflation.

In some embodiments, a sealed, air-filled chamber 3402 is formed between the panels 18 and the outer skin 612. That is, the seal across the outer skins 612 or the outer skins 612 and panels 18 seals the air that is in the space between the outside surface of the panels and the inside surface of the outer skins. This sealed, air-filled chamber 3402 can provide additional cushioning for the product that is packaged inside the panels and can prevent or reduce wrinkling of the outer skins 612. The wrinkling can be prevented by air in the chamber 3402 that holds the outer skins in a taught or blown-up condition. In one exemplary embodiment, air is blown into the air-filled chamber 3402 before sealing of the outer skins. In another exemplary embodiment, air is not blown into the chamber, but is captured during the opening, product loading, and sealing operations of the packaging operation.

While various inventive aspects, concepts and features of the general inventive concepts are described and illustrated herein in the context of various exemplary embodiments, these various aspects, concepts and features may be used in many alternative embodiments, either individually or in various combinations and sub-combinations thereof. Unless expressly excluded herein, all such combinations and sub-combinations are intended to be within the scope of the general inventive concepts. Still further, while various alternative embodiments as to the various aspects, concepts and features of the embodiments (such as alternative materials, structures, configurations, methods, circuits, devices and components, alternatives as to form, fit and function, and so on) may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the general inventive concepts even if such embodiments are not expressly disclosed herein.

Additionally, even though some features, concepts or aspects of the embodiments may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated.

Moreover, while various aspects, concepts and features may be expressly identified herein as being inventive or forming part of an invention, such identification is not intended to be exclusive, rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

What is claimed is:

1. An inflatable packaging web comprising:

a continuous web of preformed pouches defined by two panels connected together along first and second side edges and either connected together or folded along a bottom edge, wherein at least one of the panels is inflatable; and an outer skin disposed over at least one of the inflatable panels, wherein the outer skin is attached to the at least one of the inflatable panels along at least a portion of the height of the first and second side edges;

wherein the preformed pouch includes at least one fold such that a folded portion of the two panels is folded over a first portion of the two panels;

wherein the folded portion of the two panels includes an inflatable portion of the at least one of the panels.

2. The inflatable packaging web of claim 1, wherein the fold is between the first and second side edges of the two panels.

3. The inflatable packaging web of claim 2, wherein the outer skin is attached to the at least one of the inflatable panels along the entire height of the first and second side edges.

4. The inflatable packaging web of claim 2, wherein the at least one fold is arranged to unfold upon inflation of the preformed pouch.

5. The inflatable packaging web of claim 4, wherein a length of the outer skin is between 75% and 125% of a length of the inflated and unfolded preformed pouch.

6. The inflatable packaging web of claim 4, wherein a length of the outer skin is about the same as a length of the inflated and unfolded preformed pouch.

7. The inflatable packaging web of claim 2, wherein the preformed pouch includes a continuous inflation channel in fluid communication with the at least one of the inflatable panels, wherein the continuous inflation channel extends along a top of the continuous web of preformed pouches.

8. The inflatable packaging web of claim 1, wherein the at least one fold is between a top edge and the bottom edge of the two panels.

9. An inflatable packaging web comprising:

a continuous web of preformed pouches defined by two panels connected together along first and second side edges and either connected together or folded along a bottom edge, wherein at least one of the panels is inflatable; and an outer skin disposed over at least one of the inflatable panels, wherein the outer skin is attached to the at least one of the inflatable panels along at least a portion of the height of the first and second side edges;

wherein the preformed pouch includes at least one fold such that a folded portion of the two panels is folded over a first portion of the two panels;

wherein the at least one fold is between a top edge and the bottom edge of the two panels; and wherein the outer skin is attached to the at least one of the inflatable panels along a portion of the first and second side edges that is less than the entire height of the first and second side edges.

10. The inflatable packaging web of claim 8, wherein the panels have an unfolded height in an uninflated state, and wherein the unfolded height is greater than or equal to a height of the outer skin.

11. The inflatable packaging web of claim 10, wherein the panels have a second unfolded height in the inflated state, and wherein the second unfolded height is less than the unfolded height from the uninflated state.

12. The inflatable packaging web of claim 11, wherein the second unfolded height of the panels is less than or equal to the height of the outer skin.

13. The inflatable packaging web of claim 8, wherein the preformed pouch includes a continuous inflation channel in fluid communication with the at least one of the inflatable panels, wherein the continuous inflation channel extends along a top of the continuous web of preformed pouches.

14. An inflatable packaging web comprising:

a continuous web of preformed pouches defined by two panels connected together along first and second side edges and connected together along a bottom edge or folded along a bottom edge, wherein at least one of the panels includes an inflation pattern of interconnected rows that are inflatable, wherein a length of each of the interconnected rows is greater than a height of each of the interconnected rows;

an outer skin disposed over at least one of the inflatable panels, wherein the outer skin is attached to the inflatable panels at the first and second side edges;

a continuous inflation channel in fluid communication with the inflation pattern, wherein the continuous inflation channel extends along a top of the continuous web of preformed pouches.

15. An inflatable packaging web comprising:

a continuous web of preformed pouches defined by two panels connected together along first and second side edges and connected together along a bottom edge or folded along a bottom edge, wherein at least one of the panels includes one or more inflation patterns of interconnected cells that are inflatable and a plurality of cuts that are movable between an open position and a closed position;

an outer skin disposed over at least one of the inflatable panels, wherein the outer skin is attached to the inflatable panels at the first and second side edges;

a continuous inflation channel in fluid communication with the one or more inflation patterns, wherein the continuous inflation channel extends along a top of the continuous web of preformed pouches, wherein inflation of one or more inflation patterns through the continuous inflation patterns causes the plurality of cuts to move from the closed position to the open position to reduce shrinkage of the at least one inflatable panel along a length of the inflatable panel.

* * * * *